US012590417B2

(12) United States Patent
Weisang et al.

(10) Patent No.: US 12,590,417 B2
(45) **Date of Patent: *Mar. 31, 2026**

(54) CORELESS ROLLS OF A TISSUE PAPER PRODUCT AND METHODS OF MANUFACTURING CORELESS ROLLS

(71) Applicant: Essity Hygiene and Health Aktiebolag, Gothenburg (SE)

(72) Inventors: Nicolas Weisang, Kunheim (FR); Sébastien Jeannot, Kunheim (FR)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

This patent is subject to a terminal disclaimer.

(21) Appl. No.: 18/545,976

(22) Filed: Dec. 19, 2023

(65) Prior Publication Data

US 2024/0117568 A1 Apr. 11, 2024

Related U.S. Application Data

(63) Continuation of application No. 18/012,956, filed as application No. PCT/IB2020/000589 on Jul. 3, 2020.

(51) Int. Cl.
*D21H 27/00* (2006.01)
*D21H 27/32* (2006.01)

(52) U.S. Cl.
CPC ..... *D21H 27/002* (2013.01); *D21H 27/32* (2013.01)

(58) Field of Classification Search
CPC ..... D21H 27/002; D21H 27/30; D21H 27/32; D21H 27/00; D21H 23/56; B65H 18/10;
(Continued)

(56) References Cited

U.S. PATENT DOCUMENTS 2,177,490 A 10/1939 Kieffer
3,337,388 A 8/1967 Wosaba
(Continued)

FOREIGN PATENT DOCUMENTS

AU 2010304761 A1 * 4/2012 ..... A47K 10/38
CA 2049552 A1 2/1992
(Continued)

OTHER PUBLICATIONS

CN Office Action with English Translation; CN Application No. 202180047021.7; Date Mailed: Feb. 24, 2024; pp. 1-7.
(Continued)

*Primary Examiner* — Jose A Fortuna
(74) *Attorney, Agent, or Firm* — CANTOR COLBURN LLP

(57) ABSTRACT

A coreless roll of a tissue paper product has first and second ends, a web of absorbent material being wound to define an axially extending inner hole centrally positioned relative to the coreless roll, the product including at least two plies, at least one of which being an embossed ply, and the coreless roll having an outer diameter of 95-150 mm, an inner hole diameter being 20-50 mm, and a density of 110-160 kg/m$^3$, the product including glued areas, and non-glued areas between the glued areas, at least some of the glued areas including embossments of the embossed ply, a sum of areas of all glued embossed areas being at least 6% of all glued areas and all non-glued areas over at least 80% of the glued embossed areas, a maximum distance between adjacent embossments of the embossed ply being 2.5 mm or less.

22 Claims, 6 Drawing Sheets

(58) Field of Classification Search
CPC ..... B65H 18/28; B65H 19/286; B32B 2307/718; B32B 2307/72; B32B 29/00; B32B 29/005; A47K 10/16
See application file for complete search history.

(56) References Cited

U.S. PATENT DOCUMENTS 3,414,459 A 12/1968 Wells
3,556,907 A 1/1971 Nystrand
3,738,905 A 6/1973 Thomas
3,867,225 A 2/1975 Nystrand
3,953,638 A 4/1976 Kemp
3,998,690 A 12/1976 Lyness et al.
4,181,068 A 1/1980 Pollock
4,284,465 A 8/1981 Walbrun
4,320,162 A 3/1982 Schulz
4,339,088 A 7/1982 Niedermeyer
4,376,671 A 3/1983 Schulz
4,487,378 A 12/1984 Kobayashi
4,671,983 A 6/1987 Burt
5,468,323 A 11/1995 Mcneil
5,779,860 A 7/1998 Hollenberg
5,900,114 A 5/1999 Brown et al.
5,922,439 A 7/1999 Bredenick et al.
6,077,390 A 6/2000 Salman et al.
6,080,276 A 6/2000 Burgess
6,102,313 A 8/2000 Salzsauler et al.
6,544,386 B1 4/2003 Krzysik et al.
6,551,691 B1 4/2003 Hoeft et al.
6,599,614 B1 7/2003 Roussel et al.
6,610,173 B1 8/2003 Lindsay et al.
6,746,558 B2 6/2004 Hoeft et al.
6,805,766 B1 10/2004 Roussel et al.
6,913,673 B2 7/2005 Baggot et al.
7,026,037 B2 4/2006 Lefebvre et al.
7,166,189 B2 1/2007 Burazin et al.
7,291,379 B2 11/2007 Biagiotti
7,785,696 B2 8/2010 Boatman et al.
7,827,907 B2 11/2010 Koivukunnas et al.
7,829,177 B2 11/2010 Russell et al.
7,842,163 B2 11/2010 Nickel et al.
7,967,951 B2 6/2011 Suzuki et al.
7,971,526 B2 7/2011 Blenke et al.
7,992,818 B2 8/2011 Maddaleni et al.
8,158,047 B2 4/2012 Schulz et al.
8,425,730 B2 4/2013 Biagiotti
8,535,780 B2 * 9/2013 Wojcik ..... B65H 19/2276 428/153
8,597,469 B2 12/2013 Biagiotti
8,708,020 B2 4/2014 Schutz
8,920,905 B2 12/2014 Sauter et al.
8,974,892 B2 3/2015 Nencioni et al.
9,034,478 B2 5/2015 Weisang et al.
9,090,040 B2 7/2015 Sauter et al.
9,284,147 B2 3/2016 Techlin
9,365,376 B2 * 6/2016 Wojcik ..... B65H 18/22
9,375,116 B2 6/2016 Graff et al.
9,458,574 B2 10/2016 Myangiro et al.
9,637,862 B2 5/2017 Saas et al.
9,663,900 B2 5/2017 Jeannot et al.
10,213,066 B2 2/2019 Weisang et al.
10,280,567 B2 5/2019 Vogt et al.
10,350,850 B2 * 7/2019 Roesch ..... B65H 75/10
10,463,204 B2 11/2019 Barredo
10,654,239 B2 5/2020 Stefani
10,696,004 B2 6/2020 Dettori et al.
10,814,587 B2 10/2020 Kleinwaechter et al.
11,090,900 B2 8/2021 Kraus et al.
11,280,051 B2 3/2022 Satake Neto et al.
11,346,058 B2 5/2022 Pleyber et al.
11,491,699 B2 11/2022 Yoshimura
11,987,030 B2 5/2024 Dwiggins
12,018,439 B2 6/2024 Satake Neto et al.
12,071,730 B2 * 8/2024 Pleyber ..... D21H 27/008
2002/0088596 A1 7/2002 Lamb
2002/0197346 A1 12/2002 Papadopoulos
2003/0026953 A1 2/2003 Müller
2003/0111169 A1 6/2003 Baggot et al.
2003/0118784 A1 6/2003 Hollmark
2003/0129363 A1 7/2003 Hoeft et al.
2004/0028935 A1 2/2004 Hauke
2004/0166290 A1 8/2004 Sembritzki et al.
2005/0098281 A1 5/2005 Schulz et al.
2005/0178513 A1 8/2005 Russell et al.
2006/0070714 A1 4/2006 Perini
2006/0130985 A1 6/2006 Beuther et al.
2006/0222819 A1 10/2006 Gambini
2006/0283538 A1 12/2006 Schulz et al.
2007/0003736 A1 1/2007 Saarvali et al.
2007/0062658 A1 3/2007 Wiwi et al.
2007/0092700 A1 4/2007 Maddaleni et al.
2007/0093157 A1 4/2007 Shannon et al.
2007/0137813 A1 6/2007 Nickel et al.
2007/0184246 A1 8/2007 Nencioni et al.
2007/0218248 A1 9/2007 Mansson et al.
2009/0162597 A1 6/2009 Barredo et al.
2009/0226670 A1 9/2009 Schuetz
2009/0255640 A1 10/2009 Morin et al.
2009/0297781 A1 12/2009 Huss et al.
2010/0021696 A1 1/2010 Hill et al.
2010/0183350 A1 7/2010 Sauter et al.
2010/0183850 A1 7/2010 Sauter et al.
2010/0224338 A1 9/2010 Harper et al.
2010/0229738 A1 9/2010 Hirota et al.
2010/0239825 A1 9/2010 Sheehan et al.
2010/0295214 A1 11/2010 Boatman et al.
2011/0079671 A1 * 4/2011 Wojcik ..... B65H 18/22 242/532.2
2011/0123773 A1 5/2011 Lofink et al.
2012/0152445 A1 6/2012 Barredo et al.
2012/0156447 A1 6/2012 Hein et al.
2012/0164426 A1 6/2012 Barredo et al.
2012/0244241 A1 9/2012 Mcneil
2012/0255671 A1 10/2012 Wallstabe et al.
2013/0216789 A1 8/2013 Kraus et al.
2013/0327876 A1 * 12/2013 Wojcik ..... B65H 18/22 242/522
2014/0224919 A1 8/2014 Bixler et al.
2015/0184342 A1 7/2015 Saas et al.
2015/0225903 A1 8/2015 Jeannot et al.
2015/0298420 A1 10/2015 Gungner et al.
2017/0274616 A1 9/2017 Greenfield
2017/0280946 A1 10/2017 Weisang et al.
2017/0328011 A1 11/2017 Sealey et al.
2018/0014699 A1 1/2018 Barredo
2018/0104928 A1 4/2018 Dwiggins
2018/0142422 A1 5/2018 Baum et al.
2018/0187377 A1 7/2018 Ziegenbein
2018/0216398 A1 8/2018 Veerasamy
2019/0061302 A1 2/2019 Barnholtz et al.
2019/0063004 A1 2/2019 Barnholtz
2019/0078263 A1 3/2019 Glass et al.
2019/0136457 A1 5/2019 Lindsay et al.
2019/0301099 A1 10/2019 Montagnani et al.
2020/0011014 A1 1/2020 Pleyber et al.
2020/0156891 A1 5/2020 Kurosaki
2020/0263361 A1 8/2020 Weisang
2020/0277737 A1 9/2020 Weisang
2020/0298525 A1 9/2020 Dwiggins
2020/0324506 A1 10/2020 Picchi et al.
2020/0384718 A1 12/2020 Picchi et al.
2021/0070005 A1 3/2021 Kumar et al.
2021/0122561 A1 4/2021 Lemke et al.
2021/0180260 A1 6/2021 Satake Neto et al.
2021/0292972 A1 9/2021 Lecount et al.
2021/0310197 A1 10/2021 Lecount et al.
2021/0381172 A1 12/2021 Goulet et al.
2022/0010498 A1 1/2022 Pleyber et al.
2022/0112642 A1 4/2022 Giurlani et al.
2022/0154409 A1 5/2022 Curley et al.
2022/0168925 A1 6/2022 Giurlani et al.
2022/0275584 A1 * 9/2022 Satake Neto ..... D21H 27/02
2023/0146893 A1 * 5/2023 Pieroni ..... B31F 1/07 156/209

(56) References Cited

U.S. PATENT DOCUMENTS

| | | | | |
|---|---|---|---|---|
| 2023/0287630 | A1* | 9/2023 | Weisang | A47K 10/16 |
| 2024/0117566 | A1 | 4/2024 | Skarius et al. | |
| 2024/0117568 | A1* | 4/2024 | Weisang | D21H 27/32 |
| 2024/0209575 | A1* | 6/2024 | Bailey | A47K 10/16 |
| 2025/0092609 | A1* | 3/2025 | Jeannot | D21H 27/30 |
| 2025/0116069 | A1* | 4/2025 | Weisang | B32B 38/06 |
| 2025/0250743 | A1 | 8/2025 | Weisang et al. | |
| 2025/0250744 | A1 | 8/2025 | Weisang et al. | |

FOREIGN PATENT DOCUMENTS

| | | | | |
|---|---|---|---|---|
| CA | 2096140 | A1 | 10/1993 | |
| CA | 2776477 | C | 11/2018 | |
| CL | 200501067 | | 4/2006 | |
| CL | 200803570 | | 12/2009 | |
| CL | 202101610 | | 6/2021 | |
| CL | 202203775 | | 12/2022 | |
| CL | 202300009 | | 1/2023 | |
| CL | 202300010 | | 1/2023 | |
| CN | 1326523 | A | 12/2001 | |
| CN | 102574354 | A | 7/2012 | |
| CN | 104136683 | A | 11/2014 | |
| CN | 104302471 | A | 1/2015 | |
| CN | 104520506 | A | 4/2015 | |
| CN | 107250013 | A | 10/2017 | |
| CN | 207954831 | U | 10/2018 | |
| CN | 110268116 | A | 9/2019 | |
| CN | 110914037 | A | 3/2020 | |
| CN | 210362711 | U | 4/2020 | |
| CN | 111727288 | A | 9/2020 | |
| CN | 112218985 | A | 1/2021 | |
| CN | 115715342 | A * | 2/2023 | A47K 10/16 |
| CN | 115735031 | A | 3/2023 | |
| CN | 118541524 | A | 8/2024 | |
| CO | 5031318 | A1 | 4/2001 | |
| CO | 5200825 | A1 | 9/2002 | |
| CO | 5650179 | A2 | 6/2006 | |
| DE | 10137116 | A1 | 2/2003 | |
| DE | 20313418 | U1 | 10/2003 | |
| DE | 102005055707 | A1 | 5/2007 | |
| EP | 0264676 | A1 | 4/1988 | |
| EP | 338792 | A2 | 10/1989 | |
| EP | 426288 | A2 | 5/1991 | |
| EP | 499942 | A2 | 8/1992 | |
| EP | 668152 | A1 | 8/1995 | |
| EP | 739708 | A2 | 10/1996 | |
| EP | 0701641 | B1 | 9/1997 | |
| EP | 0668152 | B1 | 12/1998 | |
| EP | 934738 | A1 | 8/1999 | |
| EP | 1081284 | A1 | 3/2001 | |
| EP | 1208965 | A2 | 5/2002 | |
| EP | 0813382 | B1 | 6/2002 | |
| EP | 1321570 | A2 | 6/2003 | |
| EP | 1321576 | A2 | 6/2003 | |
| EP | 1338412 | A1 | 8/2003 | |
| EP | 1400199 | A | 3/2004 | |
| EP | 1464263 | A1 | 10/2004 | |
| EP | 1907199 | A1 | 4/2008 | |
| EP | 1996395 | A1 | 12/2008 | |
| EP | 2044264 | A1 | 4/2009 | |
| EP | 2095935 | A1 | 9/2009 | |
| EP | 2261420 | A1 | 12/2010 | |
| EP | 2292840 | A1 | 3/2011 | |
| EP | 2353859 | B1 | 8/2011 | |
| EP | 2360015 | A1 | 8/2011 | |
| EP | 2664451 | A1 | 11/2013 | |
| EP | 2692948 | A1 | 2/2014 | |
| EP | 2754553 | A2 | 7/2014 | |
| EP | 2884001 | A1 | 6/2015 | |
| EP | 2998436 | A1 | 3/2016 | |
| EP | 3143203 | A1 | 3/2017 | |
| EP | 2485973 | B1 * | 6/2017 | A47K 10/38 |
| EP | 2925202 | B1 | 7/2019 | |
| EP | 4166314 | A2 | 4/2023 | |
| EP | 4176125 | B1 | 9/2024 | |
| EP | 4077808 | B1 | 1/2025 | |
| EP | 4176124 | B1 | 1/2025 | |
| ES | 2295354 | T3 | 4/2008 | |
| ES | 2339668 | T3 | 5/2010 | |
| ES | 2578830 | A2 | 8/2016 | |
| ES | 2990036 | T3 | 11/2024 | |
| GB | 1259521 | A | 1/1972 | |
| GB | 2255745 | A | 11/1992 | |
| IT | MI951197 | A1 | 12/1996 | |
| IT | 201800006097 | A1 | 12/2019 | |
| JP | 2006045690 | A | 2/2007 | |
| JP | 2007136861 | A | 6/2007 | |
| JP | 2008094067 | A | 4/2008 | |
| JP | 2008138310 | A | 6/2008 | |
| JP | 4649118 | B2 | 3/2011 | |
| JP | 2012110407 | A | 6/2012 | |
| JP | 2015074098 | A | 4/2015 | |
| JP | 2019188021 | A | 10/2019 | |
| JP | 2020072992 | A | 5/2020 | |
| MX | 2014012792 | A | 3/2015 | |
| WO | 9406623 | A1 | 3/1994 | |
| WO | 9711228 | A1 | 3/1997 | |
| WO | 9720107 | A1 | 6/1997 | |
| WO | 9733043 | A1 | 9/1997 | |
| WO | 9743483 | A1 | 11/1997 | |
| WO | 9743484 | A1 | 11/1997 | |
| WO | 9821410 | A1 | 5/1998 | |
| WO | 9847706 | A1 | 10/1998 | |
| WO | 9915332 | A1 | 4/1999 | |
| WO | 9923290 | A1 | 5/1999 | |
| WO | 9923299 | A1 | 5/1999 | |
| WO | 9936253 | A1 | 7/1999 | |
| WO | 9945205 | A1 | 9/1999 | |
| WO | 9953140 | A1 | 10/1999 | |
| WO | 9959511 | A2 | 11/1999 | |
| WO | 0061358 | A1 | 10/2000 | |
| WO | 0125537 | A1 | 4/2001 | |
| WO | 0147699 | A1 | 7/2001 | |
| WO | 0148314 | A2 | 7/2001 | |
| WO | 0202869 | A2 | 1/2002 | |
| WO | 02103112 | A1 | 12/2002 | |
| WO | 03043806 | A2 | 5/2003 | |
| WO | 03045681 | A1 | 6/2003 | |
| WO | 03059139 | A1 | 7/2003 | |
| WO | 03072344 | A1 | 9/2003 | |
| WO | 2004042142 | A1 | 5/2004 | |
| WO | 2004094726 | A1 | 11/2004 | |
| WO | 2005064044 | A1 | 7/2005 | |
| WO | 2005080677 | A2 | 9/2005 | |
| WO | 2005095100 | A1 | 10/2005 | |
| WO | 2006133389 | A2 | 12/2006 | |
| WO | 2007030592 | A2 | 3/2007 | |
| WO | 2007046124 | A1 | 4/2007 | |
| WO | 2007070129 | A1 | 6/2007 | |
| WO | 2007071734 | | 6/2007 | |
| WO | 2007078363 | A1 | 7/2007 | |
| WO | 2007103433 | A2 | 9/2007 | |
| WO | 2008048151 | A1 | 4/2008 | |
| WO | 2008069147 | A1 | 6/2008 | |
| WO | 2010009769 | A1 | 1/2010 | |
| WO | 2010023616 | A2 | 3/2010 | |
| WO | 2010086837 | A2 | 8/2010 | |
| WO | 2010135074 | A1 | 11/2010 | |
| WO | 2010139759 | A1 | 12/2010 | |
| WO | WO-2011042818 | A2 * | 4/2011 | A47K 10/38 |
| WO | 2011078755 | A1 | 6/2011 | |
| WO | 2013179109 | A2 | 12/2013 | |
| WO | 2014020424 | A1 | 2/2014 | |
| WO | 2015175281 | A1 | 11/2015 | |
| WO | 20150186052 | A1 | 12/2015 | |
| WO | 2016132168 | A1 | 8/2016 | |
| WO | 2016159966 | A1 | 10/2016 | |
| WO | 2017019421 | A1 | 2/2017 | |
| WO | 2017037273 | A1 | 3/2017 | |
| WO | 2017134846 | A1 | 8/2017 | |
| WO | 2017168195 | A1 | 10/2017 | |
| WO | 2017196516 | A1 | 11/2017 | |
| WO | 2017197405 | A1 | 11/2017 | |
| WO | 2017209738 | A1 | 12/2017 | |

(56) References Cited

FOREIGN PATENT DOCUMENTS

| | | | | |
|---|---|---|---|---|
| WO | 201873985 | A1 | 4/2018 | |
| WO | 2018166572 | A1 | 9/2018 | |
| WO | 2018217599 | A1 | 11/2018 | |
| WO | 2018217602 | A1 | 11/2018 | |
| WO | 2018229676 | A1 | 12/2018 | |
| WO | 201904225 | A1 | 1/2019 | |
| WO | 201959180 | A1 | 3/2019 | |
| WO | 2019064044 | A1 | 4/2019 | |
| WO | 2019064045 | A1 | 4/2019 | |
| WO | 2019064046 | A1 | 4/2019 | |
| WO | 2019203699 | A1 | 10/2019 | |
| WO | 2019219168 | A1 | 11/2019 | |
| WO | 2020068839 | A1 | 4/2020 | |
| WO | 2020128551 | A1 | 6/2020 | |
| WO | 2021126026 | A1 | 6/2021 | |
| WO | WO-2022003383 | A1 * | 1/2022 | ..... A47K 10/16 |
| WO | 2024226558 | A1 | 10/2024 | |

OTHER PUBLICATIONS

Chinese Application No. 202080102390.7; Chinese Office Action with English translation dated Aug. 1, 2023; 18 pages.
Chinese Application No. 202080102393.0; Office Action with English translation dated Sep. 20, 2023; 11 pages.
Chinese Application No. 202080102449.2; Chinese Office Action with English translation dated Sep. 7, 2023; 20 pages.
Chinese Application No. 202180047021.7; Chinese Office Action with English translation dated Sep. 22, 2023; 28 pages.
International Preliminary Report on Patentability for International Application No. PCT/IB2020/000586; International Filing Date: Jul. 3, 2020; Date of Mailing: Sep. 29, 2022; 25 pages.
International Search Report & Written Opinion for International Application No. PCT/IB2020/000583; International Filing Date: Jul. 3, 2020; Date of Mailing: Feb. 24, 2021; 13 pages.
International Search Report & Written Opinion for International Application No. PCT/IB2020/000586; International Filing Date: Jul. 3, 2020; Date of Mailing: Mar. 9, 2021; 12 pages.
International Search Report & Written Opinion for International Application No. PCT/IB2020/000588; International Filing Date: Jul. 3, 2020; Date of Mailing: Feb. 22, 2021; 11 pages.
International Search Report & Written Opinion for International Application No. PCT/IB2020/000589; International Filing Date: Jul. 3, 2020; Date of Mailing: Feb. 24, 2021; 11 pages.
International Search Report & Written Opinion for International Application No. PCT/IB2020/000592; International Filing Date: Jul. 3, 2020; Date of Mailing: Feb. 26, 2021; 15 pages.
International Search Report & Written Opinion for International Application No. PCT/IB2020/000595; International Filing Date: Jul. 3, 2020; Date of Mailing: Apr. 7, 2021; 17 pages.
International Search Report & Written Opinion for International Application No. PCT/IB2021/000458; International Filing Date: Jul. 2, 2021; Date of Mailing: Nov. 2, 2021; 19 pages.
Written Opinion of the International Preliminary Examining Authority for International Application No. PCT/IB2020/000586; International Filing Date: Jul. 3, 2020; Date of Mailing: May 19, 2022; 8 pages.
U.S. Appl. No. 18/012,956, filed Dec. 26, 2022; Notice of Allowance mailed Mar. 18, 2024; 97pages.
Chilean Application No. 202203663; CL Office Action with English translation dated Jan. 8, 2024; 19 pages.
U.S. Appl. No. 18/012,956, filed Dec. 26, 2022; Non-Final Office Action mailed Jun. 23, 2023; 186 pages.
U.S. Appl. No. 18/012,956, filed Dec. 26, 2022; Notice of Allowance dated Sep. 20, 2023; 8 pages.
Chinese Application No. 202080102449.2; Chinese Office Action with English translation dated Feb. 3, 2024; 38 pages.
Mexican Application No. MX/E/2023/050579; Third Party Observation dated Jul. 17, 2023; 100 pages.
Mexican Application No. MX/E/2023/050580; Third Party Observation dated Jul. 17, 2023; 50 pages.
Chinese Application No. 202080102451.X; First Office Action dated Dec. 23, 2023; 29 pages.
Colombian Office Action NC2023/0001170; Office Action with English translation dated Aug. 20, 2024; 19 pages.
Colombian Patent Office, Office Action issued in CO NC2019/0010000 dated Aug. 9, 2021 with partial English Translation (15 apges).
International Searching Authority, Search Report and Written Opinion issued in International Application No. PCT/EP2017/055795 mailed Nov. 9, 2017 (14 pages).
National Intellectual Property Administration (Cnipa) of the People's Republic of China, Office Action issued in App. No. 201780086232.5 dated Nov. 19, 2021 with English Translation (17 pages).
U.S. Appl. No. 16/491,006; Notice of Allowance dated Feb. 4, 2022; 34 pages.
U.S. Appl. No. 18/012,955; Non-Final Office Action dated Nov. 5, 2024; 204 pages.
U.S. Appl. No. 18/013,735; Non-Final Office Action dated Nov. 4, 2024; 88 pages.
U.S. Appl. No. 18/012,966; Non-Final Office Action dated Aug. 29, 2024; 68 pages.
Chilean Application No. 202203662; CL Office Action with English translation dated Aug. 16, 2024; 18 pages.
Chinese Application No. 202080102548.0; Office Action with English translation dated Sep. 12, 2024; 28 pages.
U.S. Appl. No. 18/012,956; Non-Final Office Action dated Sep. 28, 2024; 22 pages.
Chilean Application No. 202203662; CL Office Action with English translation dated Mar. 21, 2024; 20 pages.
Chinese Application No. 202080102548.0; First Office Action dated Apr. 3, 2024; 25 pages.
Chilean Application No. 202203775; Office Action with English dated Sep. 5, 2024; 35 pages.
U.S. Appl. No. 18/013,667; Restriction Requirement dated Sep. 17, 2024; 8 pages.
Chilean Application No. 202300008; Office Action with English translation dated Nov. 20, 2024; 25 pages.
Chilean Application No. 202300010; Office Action with English translation dated Nov. 14, 2024; 31 pages.
Chinese Application No. 202080102451X; Office Action with English translation dated Jan. 15, 2025; 31 pages.
Chinese Application No. 2020801025480; Office Action with English translation dated Jan. 3, 2025; 21 pages.
Colombian Application No. NC2022/0017942; Office Action with English translation dated Oct. 30, 2024; 29 pages.
Colombian Application No. NC2022/0018141; Office Action with English translation dated Oct. 30, 2024; 15 pages.
Colombian Application No. NC2023/0001168; Office Action with English translation dated Sep. 12, 2024; 24 pages.
Colombian Patent Application No. NC2023/0001172; Office Action with English translation dated Aug. 27, 2024; 16 pages.
Ukraine Application No. 22546/3A/24; Office Action with English translation dated Nov. 13, 2024; 13 pages.
U.S. Appl. No. 18/012,956; Final Office Action dated Feb. 14, 2025; 30 pages.
Chilean Application No. 202300009; Office Action with English translation dated Nov. 12, 2024; 34 pages.
Chinese Application No. 202080102451X; Decision of Rejection dated Jan. 15, 2025; 31 pages.
Colombian Application No. NC2022/0018141; Office Action with English translation dated Feb. 25, 2025; 20 pages.
U.S. Appl. No. 18/724,456; Non-Final Office Action dated May 5, 2025; 264 pages.
U.S. Appl. No. 18/012,956; Final Office Action dated Apr. 22, 2025; 27 pages.
U.S. Appl. No. 18/012,966; Final Office Action dated Apr. 16, 2025; 22 pages.
Singapore Application No. 11202261481U; Office Action dated Apr. 29, 2025; 5 pages.
U.S. Appl. No. 18/013,817; Final Office Action dated May 5, 2025; 18 pages.

(56) References Cited

OTHER PUBLICATIONS

Chilean Application No. 202300011; Office Action dated Apr. 7, 2025; 36 pages.
Chinese Application No. 202080102647.9; Office Action dated May 1, 2025; 26 pages.
Singapore Application No. 11202261586X; Written Opinion dated Apr. 29, 2025; 5 pages.
U.S. Appl. No. 18/013,703; Non-Final Office Action dated Jun. 9, 2025; 130 pages.
U.S. Appl. No. 18/012,956, filed Dec. 26, 2022; Notice of Allowance dated Jul. 8, 2025; 14 pages.
Chemical Technology of Pulp and Papermaking, 3rd edition, vol. 2, edited by J.P. Kathy (US), Light Industry Press, Mar. 1988, p. 365-366; With English Translation; 33 pages.
Chinese Application No. 202080102451.X; Office Action with English translation dated Jul. 21, 2025; 39 pages.
Papermaking II, Drying, by (Finland) Komanku et al., China Light Industry Press, Jul. 2018, pp. 128-130; 13 pages.
Ukraine Application No. a 2022 04975; Office Action with English translation dated Jun. 23, 2025; 13 pages.
U.S. Appl. No. 18/013,817; Non-Final Office Action dated Aug. 11, 2025; 16 pages.
Papermaking II, Drying, by (Finland) Komanku et al., China Light Industry Press, Jul. 2018, pp. 128-130; 22 pages.
U.S. Appl. No. 18/724,456; Final Office Action dated Sep. 25, 2025; 70 pages.
U.S. Appl. No. 18/012,966; Non-Final Office Action dated Sep. 10, 2025; 38 pages.
Colombian Patent Application No. NC2022/0017941; Office Action with English translation dated Sep. 22, 2025; 10 pages.
Columbian Office Action, Application No. PCT/IB2020/000588, mailed Sep. 30, 2025; with English translation, 30 pages.
Columbian Office Action, Application No. NC2023/0001172, mailed Oct. 1, 2025, with English Translation, 23 pages.
Mexican Office Action, Application No. MX/a/2024/008090, mailed Janury 8, 2026, with English Translation, 34 pages.
National Intellectual Property Administration (CNIPA) of the People's Republic of China, Application No. 202180105263.7 mailed Jan. 15, 2026, with English Translation, 13 pages.

* cited by examiner

CORELESS ROLLS OF A TISSUE PAPER PRODUCT AND METHODS OF MANUFACTURING CORELESS ROLLS

CROSS REFERENCE TO RELATED APPLICATION

This application is a continuation of U.S. application Ser. No. 18/012,956, filed Dec. 26, 2022, which is a National Stage application of PCT/IB2020/000589, filed Jul. 3, 2020, both of which are incorporated by reference in their entirety herein.

TECHNICAL FIELD

The present disclosure relates to coreless rolls of a tissue paper product, such as toilet paper, made of a spirally wound continuous web of tissue paper product. The disclosure also relates to methods of manufacturing coreless rolls of a tissue paper product, such as toilet paper.

TECHNICAL BACKGROUND

In the following, a "tissue paper product" relates to an absorbent paper based on cellulose wadding. The latter is also referred to as a tissue paper base-sheet in this field of technology.

Fibres contained in a tissue paper product are mainly cellulosic fibres, such as pulp fibres from chemical pulp (e.g. Kraft or sulphite), mechanical pulp (e.g. ground wood), thermo-mechanical pulp, chemo-mechanical pulp and/or chemo-thermo-mechanical pulp (CTMP). Pulps derived from both deciduous (hardwood) and coniferous (softwood) can be used. Fibres may also come from non-wood plants, e.g., cereal, bamboo, jute, and sisal. The fibres or a portion of the fibres may be recycled fibres, which may belong to any or all of the above categories. The fibres can be treated with additives, e.g. fillers, softeners, such as, but not limited to, quaternary ammonium compounds and binders, conventional dry-strength agents, temporary wet strength agents or wet-strength agents, in order to facilitate the original paper making or to adjust the properties thereof. The tissue paper product may also contain other types of fibres, e.g., regenerated cellulosic fibres or synthetic fibres for enhancing, for instance, strength, absorption, smoothness or softness of the tissue paper product.

Whenever reference is made to the "softness" of a tissue paper product in this text, reference is made to the property of softness measured by a softness test method relying on a TSA" (Tissue Softness Analyzer). TSA uses acoustic waves and has been demonstrated to correlate well with hand panel tests for thin materials like tissue paper. The test method follows the general outline of the TSA instrument manual dated 2013 Jul. 8 (Collection of the TSA Operating instruction, Multi Functional Measuring system, Tissue Softness Analyzer, 2012 Dec. 12, available from EMTEC electronic GMBH with the settings as set forth therein or in WO 2019/221647 A1 in the name of Essity Hygiene and Health Aktiebolag.

The Tissue Softness Analyzer TSA simultaneously gathers the single relevant parameters which have an influence on the tissue softness, and provides a comfort prediction. The comfort prediction may be used to determine the softer one out of two tissues being compared. A higher value indicates a higher softness.

Tissue paper products may be used for personal and household use as well as for commercial and industrial use.

They may be adapted to absorb fluids, remove dust, and for other cleaning purposes. If tissue paper is to be made out of pulp, the process essentially comprises a forming step that includes a headbox- and a forming wire section, and a drying section, either through air drying or conventional drying on a Yankee cylinder. The production process may also include a crepe and, finally, typically a monitoring and winding step.

Several plies may be combined together by a combining operation of a chemical nature (e.g., by adhesive bonding), or of a mechanical nature (e.g., by knurling or so-called edge-embossing), or a combination of both.

Further, the processing to finished tissue product may involve, e.g., longitudinal cut, cross cut, etc. Moreover, individual tissue products may be positioned and brought together to form stacks, which may be individually packaged. Such processing steps may also include application of substances like scents, lotions, softeners or other chemical additives.

When several plies are combined together using adhesive bonding, a film of adhesive is deposited over some or all of the surface of at least one of the plies, then the adhesive-treated surface is placed in contact with the surface of at least one other ply.

When several plies are combined together using mechanical bonding, the plies may be combined by knurling, by compression, by edge-embossing, union embossing and/or ultrasonic.

Mechanical and adhesive bonding may also be combined to combine several plies.

The processing step from the base tissue to a finished tissue paper product occurs in processing machines (converting machines) which include operations such as unwinding the base tissue, calendaring of the tissue, laminating, printing or embossing together to form a multi-ply product.

Embossing can be used to change the shape of a ply from flat to shaped, so that there are areas that are raised and/or recessed from the rest of the surface. It therefore constitutes a deformation of the previously flat sheet, and results in a ply having a particular relief. Usually, the thickness of the ply or of the multiple plies is increased after embossing compared with its initial thickness.

An embossing process is carried out between an embossing roll and a counter roll. The embossing roll can have protrusions or depressions on its circumferential surface leading to embossed protrusions/depressions in the paper web. Counter rolls may be softer than the corresponding embossing roll and may consist of rubber, such as natural rubber, or plastic materials, paper or steel. If the counter roll is made of a softer material like rubber, a contact area/nip can be formed between the embossing roll (e.g., steel roll) and the counter roll by the deformation of the softer roll.

By embossing, a pattern can be applied to a tissue paper fulfilling a decorative and/or functional purpose. A functional purpose may be to improve the properties of the hygiene paper product, that is, the embossment may improve the product thickness, absorbency, bulk, softness, etc. A functional purpose may also be to provide a joint to another ply in a multi-ply product.

Another type of embossment is referred to herein as a "pre-embossment". A pre-embossment could preferably be applied to a web or ply prior to its joining to the other plies of a multi-ply tissue product.

Such pre-embossment may be made for a functional purpose e.g. as laid out in the above to increase the thickness of the ply, the absorbency, bulk and/or softness.

"Micro-embossment" is used herein for an embossment pattern with a dense configuration. Typically, the micro-embossment may comprise dots in the range 20 to 100 dots per cm2, preferably 40 to 80 dots per cm2. A micro-embossment may advantageously be a pre-embossment. The micro-embossed dots may have different relatively simple surface shapes such as circles, ovals, squares, rectangles or diamonds.

It has become known to produce rolls of tissue paper products, such as toilet paper, without a core (e.g., without an additional cardboard core), so-called coreless rolls. This is appealing as a reduction of waste is achieved (as the cores of used rolls were a waste product). However, the coreless rolls are not always as satisfying for customers as rolls with a core, e.g., due to a reduced stability in comparison to the rolls with a core.

There is, hence, a need for improved coreless rolls, improving customer satisfaction while nevertheless allowing to reduce waste (by avoiding, in particular, the need of providing cores which usually end up as waste). Specifically, such coreless rolls should address at least one of the above-mentioned shortcomings. Moreover, there is a need for manufacturing methods for improved coreless rolls that address at least one of the above-mentioned shortcomings.

SUMMARY

One aspect of the above-mentioned object is achieved by a coreless roll of a tissue paper product, such as toilet paper, in accordance with the present disclosure. The coreless roll is made of a spirally wound continuous web of tissue paper having a first end and a second end, the web of absorbent material being wound such as to define an axially extending inner hole centrally positioned relative to the coreless roll and such that the first end is located on the outer side of the coreless roll and the second end is located at the inner hole.

The tissue paper product comprises at least two plies, wherein all of the plies of the tissue paper product are made of Conventional Wet Press paper (CWP). At least one of the plies is an embossed ply, i.e., a ply comprising embossments. Being an "embossed ply" does not mean that the entire ply needs to be covered with embossments (although in the case of some embodiments, embossments may indeed be spread out over the entire ply). It means instead that embossments are present on the ply, irrespective of how many embossments are present. In other words, the embossed ply may comprise embossments everywhere, or there may be embossments only in a region or in some regions, etc. An embossed ply is manufactured by embossing the ply with an embossing roll (usually between an embossing roll and a counter roll) provided with embossing protrusions which are used to form the embossments on the ply.

The coreless roll has an outer diameter in the range of 95 to 150 mm. A diameter of the inner hole is in the range of 20 to 50 mm. The diameter of the inner hole, as referred to in this text, is to be understood to be an "average diameter" obtained by dividing the perimeter of the inner hole by $\pi$ ($\pi$ may, of course, be approximated, e.g., by 3.14). The actual distance between opposing surfaces of the inner hole may vary as one moves along the perimeter, as the inner hole does not need to have a round cross-sectional shape, but is typically a bit irregular (depending, e.g., on how the roll was transported, etc.).

A density of the coreless roll is in a range of 110 to 160 $kg/m^3$. The roll density is defined (throughout this text) as the ratio between the weight of the roll and the volume of tissue paper product. The expression "volume of the tissue paper product" is used to refer to the difference between the external volume of the coreless roll (i.e., the volume defined by the outer cylindrical shape of the entire roll) and the volume of the inner cylinder defined by the inner hole. In other words, the volume may be thought of as the volume of an outer cylinder subtracted by the volume of the inner cylinder.

The tissue paper product comprises glued areas, where the plies are ply-bonded to each other using an adhesive such as a lamination glue, and non-glued areas between the glued areas.

Within the glued areas, the adhesive need not be provided everywhere, in the sense that the adhesive can, for example, be concentrated in regions (such as embossments dots or, put differently, tips of particular embossments, etc.) spread out throughout the respective glued areas. According to alternative embodiments, the adhesive may instead spread out over the entire glued areas (or at least some of the glued areas).

At least some of the glued areas are glued embossed areas, i.e., glued areas that comprise embossments of the embossed ply. The glued embossed areas may thus be a subset of the glued areas. In other words, some glued areas may not comprise embossments and may thus not be glued embossed areas. Moreover, additional embossments may be located elsewhere, i.e., outside of glued areas. Thus, the glued embossed areas may be considered to constitute the overlap between glued areas and embossed areas.

A sum of areas of all glued embossed areas is at least 6% of a sum of the areas of all glued areas and of areas of all non-glued areas. On a tissue paper product, the percentage of the areas of all glued embossed areas, can, for example, be quantified on a unit sheet of the tissue paper product, the unit sheet, e.g., being a sheet of a particular length (such as 5 cm, 7 cm, 10 cm, etc.). Alternatively, the unit sheet may be one sheet of tissue paper products confined by perforation lines for tearing off the sheet, as is customarily found in kitchen paper or toilet paper. The glued embossed areas amount to 6% of the total area (of the tissue paper product, or, at least locally, of a part thereof, such as on some sheet).

Over at least 80% of the glued embossed areas, a maximum distance between adjacent embossments of the embossed ply is 2.5 mm or less, optionally 2.0 mm or less, or 1.5 mm or less. This means that the maximum distance in question is maintained across 80% of the sum of all glued embossed areas. In other words, more than the maximum distance may be present between adjacent embossments over up to 20% of the sum of all glued embossed areas. The larger distances may be present on a fraction of each glued embossed area. Alternatively, the larger distances may be present only in some (but not all of the) glued embossed areas. In other words, the 20% deviation from the maximum distance requirement may be distributed onto the glued embossed areas in any way. The maximum distance in question may be maintained over 80% of the glued embossed areas in the sense that the entire areas of 80% of the glued embossed areas may maintain it. "Over at least 80%" just means that, overall, at least 80% of the sum of all surfaces of all glued embossed areas, respects the maximum distance in question.

"At least 80% of the glued embossed areas" may be 80% of the sum of all surfaces of a repetitive unit of the tissue paper product. The tissue paper product comprises repetitive units based on the fact that all of the rolls used to manufacture the repetitive units process adjacent parts of the plies which will be comprised in the product successively, so that a periodicity is generated.

The coreless rolls with a tissue paper product in accordance with the present disclosure may have a particularly high radial compression strength. Specifically, the radial compression strength of such rolls may be 20N or more, or even 25N or more, or even 30N. These are robust and meet the requirements, e.g., for toilet paper rolls. Thus, they may achieve customer satisfaction. In particular, the criteria of having a ratio of at least 6% of glued embossed areas and having the indicated maximum distance between adjacent embossments over at least 80% of the glued embossed areas may, in particular, promote the high radial compression strength.

If the sum of the areas of all glued embossed areas is lower than 6% of the sum of the areas of all glued areas and of the areas of all non-glued areas, the glued embossments may have to be spread out too much for being able to promote a satisfactory integrity of the products (in the sense of promoting a satisfactorily high radial compression strength) without impairing the thickness and/or desirably large caliper and/or sufficiently high softness of the tissue paper product. Trying to concentrate the embossments sufficiently to have a sufficiently strong bonding and to sufficiently promote a large radial compression strength, despite the sum of the areas of all glued embossed areas being lower than 6% of the sum of the areas of all glued areas and of the areas of all non-glued areas, may not be possible due to technical reasons relating to engravement. The necessary maximum distances between adjacent embossments may otherwise no longer be maintained.

Whenever reference is made to the "thickness" of a tissue paper product in this text, reference is made to the thickness as obtained in accordance with European standard EN 12625-3 using the Frank Thickness Gauge equipment (Model 16502) or the like. The tissue paper sheet to be measured is cut into pieces of a minimum length 80 mm in any direction, and the pieces are conditioned at 23° C., 50% RH (Relative Humidity) for at least 2 hours. During measurement a sample piece is placed between a fixed bottom plate and a pressure foot. The pressure foot is then lowered at a speed of 2.0 mm/s. The thickness value for the sheet is then read after the pressure value is stabilized. The Essity Internal diameter of the pressure foot is 35.7 mm. The lower plate dimension is minimum 20% bigger. The pressure applied is 2.0 kPa during the measurement.

Whenever reference is made to the radial compression strength in this document, reference is made to the radial compression strength measured as follows. A sample coreless roll is inserted into a standard dynamometer with two parallel plates, a top plate and a bottom plate (which are large enough to sandwich a coreless roll and to apply pressure to contact surfaces), the plates, e.g., being metallic plates. The coreless roll is put on the bottom plate, a plastic mandrel is inserted (e.g., a mandrel with a diameter in range of 15 mm to 40 mm) in the inside hole of the coreless roll. The bottom plate and the top plate are then moved towards each other, usually by moving the upper plate towards a lower plate that is fixed and not moveable (using a compression speed of 60 mm/min and, for example, using a dynamometer with a cell of, e.g., 200N), and it is measured how much pressure (in Newton) needs to be exerted onto the coreless roll until the inside of the coreless roll exerts pressure onto the mandrel. The pressure exerted onto the coreless roll at which in turn the exertion of pressure by the inside of the coreless roll onto the mandrel starts, is the radial compression strength of the coreless roll. A minimum number of five serial measurements may be required in order to obtain a statistically significant result/measurement. The serial measurements need to be performed on separate rolls (from the same production series), in order to obtain reliable results. The sample rolls need to be pre-conditioned, and measurements need to be carried out in accordance with the standard norm ISO187.

According to some embodiments, at least 80% of the tissue paper product is covered by parts of glued embossed areas in which the maximum distance between adjacent embossments of the embossed ply is 2.5 mm or less, optionally 2.0 mm or less, or 1.5 mm or less. Analogous statements hold with respect to embodiments of the method in accordance with the present disclosure.

According to some embodiments, an embossment density may be at least 20 embossments/cm$^2$, optionally at least 40 embossments/cm$^2$ (or higher minimum numbers such as 45, 50, or 55), over at least 80% of the glued embossed areas. The at least 80% of the glued embossed areas, where the mentioned density holds, may coincide with or at least overlap with the at least 80% of the glued embossed areas, where the above-mentioned range for the maximum distance between adjacent embossments is satisfied.

As mentioned already, the adhesive may be concentrated within the glued embossed areas (for, example, at tips of embossments) or it can be spread out homogenously over the entire glued embossed areas (i.e., there may be a coverage of adhesive over the entire glued embossed areas or at least over parts of at least some of the glued embossed areas. For example, at least 90%, optionally 95%, of the adhesive in the glued embossed areas may be present where tips of embossments on the embossed ply are located.

According to some embodiments, the embossed ply comprises first embossments with a first embossment height and at least one further type of embossments with a height smaller than the first embossment height.

At least 70%, or 80%, 90%, or 95%, of the adhesive in the glued embossed areas may be present where tips of the first embossments are located.

The sum of the areas of all glued embossed areas may be at least 6% of a total area of the tissue paper product. In other words, the mentioned 6%-criterion may be fulfilled over the entire tissue paper product. Alternatively, it may be fulfilled over only a part of the tissue paper product (e.g., over regular pieces of a particular length).

The glued embossed areas may be arranged in a repetitive pattern. The repetitive pattern may repeat a repeating unit in a direction of a length extension of the tissue paper product along the roll. This may be associated with the fact that embossing rolls may impart a periodicity to the plies which they emboss.

A sample unit of the tissue paper product will now be referred to as a section with a minimum length in the direction of the length extension that comprises one repeating unit. Specifically, the sum of the areas of all glued embossed areas may be at least 6% of the sum of the areas of all glued areas and of all non-glued areas in the sample unit. In other words, the presence of the 6%-criterion may be verified using a sample unit of the tissue paper product in accordance with the mentioned definition.

The glued embossed areas may constitute at least 90%, optionally at least 95% or at least 98% of all glued areas. In other words, the amount of glued areas, which are not glued embossed areas (i.e., areas with adhesive but without embossments) may be limited (to an increasing degree). According to some embodiments, all of the glued areas may be glued embossed areas.

At least 75%, optionally at least 80%, at least 85%, or at least 90%, or at least 95% of the embossments of the embossed ply may be provided in the glued embossed areas. In other words, the amount of embossments provided outside of the glued embossed areas may be limited to an increasing degree. However, there is space for embossments outside of the glued embossed areas. For example, embossed logos may be provided, which are not provided with any adhesive. Thus, logos may constitute embossed areas but not glued embossed areas. Alternatively, glued embossed logos may be provided.

According to some of the embodiments, at least 80%, optionally at least 90% or at least 95%, of the glued embossed areas comprise at least 25, optionally at least 30 embossments. The embossments may also be referred to as dots. In other words, the majority of the glued embossed areas may comprise a minimum number of embossment dots of 20, or, according to other embodiments, 40 dots (or higher minimum numbers such as 45, 50, or 55).

At least a part of an innermost circumvolution, optionally the entire innermost circumvolution, of the tissue paper product of the coreless roll at the second end may comprise a stabilizing coating composition. This may aid in promoting good radial and/or axial stability of the coreless roll.

The coating composition may comprise at least one of the following list: a polymer including oxygen and/or nitrogen atoms, a non-ionic polymer such as a non-ionic cellulose ether, polyether polyol.

The coating composition may comprise water.

When the coating composition comprises a nonionic polymer, the ionic demand may be in a range of from −1000 to +100 μeq/g, or −500 to +50 μeq/g, or −50 to 0 μeq/g.

The coating composition may be applied to only one side of the innermost turn. This one side may be side oriented towards the axially extending inner hole.

According to some embodiments, a maximum distance between adjacent embossments of the embossed ply may be 2.5 mm or less, optionally 2.0 mm or less, or 1.5 mm or less over at least 80% of a sum of all surfaces of a repetitive unit of the tissue paper product, where the glued embossed areas are located.

According to some embodiments, a maximum distance between adjacent embossments of the embossed ply may be 2.5 mm or less, optionally 2.0 mm or less, or 1.5 mm or less over at least 80% of a sum of all surfaces of the tissue paper product, where the glued embossed areas are located.

Some embodiments of the coreless roll comprise a tissue paper product comprising exactly two plies. The two plies will in the following be referred to as a first ply and a second ply. The density of the coreless roll is in a range of 110 to 150 kg/m$^3$. The sum of the areas of all glued embossed areas is at least 6%, optionally at least 7% or at least 8% or at least 9%, of the sum of the areas of all glued areas and of all non-glued areas.

The tissue paper product comprises two plies. In fact, a total number of plies of the tissue paper product is two. Put differently, the tissue paper product consists of two plies. However, the latter statement does not imply that the tissue paper product cannot comprise other constituents (other than plies), such as adhesive, additives, etc. It means only that the number of plies is two. At least one of the two plies is an embossed ply. However, both plies may be embossed plies.

The coreless rolls with a tissue paper product made of two plies described above may have a particularly high radial compression strength. Specifically, the radial compression strength of such rolls may be 20N or more, or even 25N or more, or even 30N. These are robust and meet the requirements, e.g., for toilet paper rolls.

According to some embodiments, the first ply is embossed and the second ply is embossed.

According to some embodiments, a caliper of the tissue paper product is at least 0.35 mm, optionally at least 0.40 mm or at least 0.45 mm.

A grammage of the tissue paper product comprising exactly two plies may be in a range of 24 g/m$^2$ to 50 g/m$^2$, optionally in a range of 30 g/m$^2$ to 45 g/m$^2$.

The high radial compression strength of the products may be increasingly promoted by the increasingly narrower ranges of grammage specified for the two-ply tissue paper product.

Whenever reference is made to the "grammage" (or "basis weight") in this text, reference is made to the basis weight (grammage) as determined by a test method following the principles set forth in standard EN ISO 12625-6:2016 for determining the basis weight. Test pieces of 50 cm$^2$ are punched from the sample sheet. Test pieces are chosen randomly from the entire sample and should be free of folds, wrinkles and any other deviating distortions. The pieces are conditioned at 23° C., 50% RH (Relative Humidity) for at least 2 hours. A pile of 20 pieces is weighed on a calibrated balance. The basis weight (grammage) is the weighed mass divided by the total area 1000 cm$^2$ (20×50 cm$^2$) and recorded as mean value with standard deviations.

The first ply may comprise first embossments with a first height (h1), the first height (h1) being in a range of 0.2 mm to 2.0 mm. The adhesive, such as lamination glue, may be applied to tips of the first embossments of the first ply.

The second ply may comprise second embossments with a second height (h2), the second height (h2) being in a range of 0.2 mm to 2.0 mm.

The first ply may comprise third embossments with a third height (h3) smaller than the first height h1 (h1>h3). In other words, adhesive may be applied to tips of the higher embossments (i.e., those with a larger embossing height).

The third embossments (if present) may have been formed by the same embossing roll as the first embossments or, alternatively, by a different embossing roll.

The second ply may comprise fourth embossments with a fourth height (h4) smaller than the second height h2 (h2>h4). In other words, adhesive may be applied to tips of the higher embossments (i.e., those with a larger embossing height).

The fourth embossments (if present) may have been formed by the same embossing roll as the second embossments or, alternatively, by a different embossing roll.

Some embodiments of the coreless roll in accordance with the present disclosure comprise a tissue paper product including exactly three plies. The at least one embossed ply is one of the outermost plies. The density of the coreless roll is in a range of 130 to 160 kg/m$^3$. The sum of the areas of all glued embossed areas is at least 6%, optionally at least 7%, or at least 8% of the sum of the areas of all glued areas and of all non-glued areas.

The tissue paper product comprises three plies. In fact, a total number of plies of the tissue paper product is three. Put differently, the tissue paper product consists of three plies. However, the latter statement does not imply that the tissue paper product cannot comprise other constituents (other than plies), such as adhesive, additives, etc. It means only that the number of plies is three. At least one of the three plies is an embossed ply. One of the three, two of the three, or all three plies may be embossed plies.

The coreless rolls with a tissue paper product made of three plies described above may have a particularly high radial compression strength. Specifically, the radial compression strength of such rolls may be 20N or more, or even 25N or more, or even 30N. These are robust and meet the requirements, e.g., for toilet paper rolls. This property may be increasingly promoted by the increasingly narrower ranges of grammage specified for the three-ply tissue paper product.

A caliper of the tissue paper product may be at least 0.40 mm, optionally at least 0.45 mm or at least 0.50 mm.

A grammage of the tissue paper product may be in a range of from 34 $g/m^2$ to 65 $g/m^2$, optionally 40 $g/m^2$ to 63 $g/m^2$, or 45 $g/m^2$ to 60 $g/m^2$.

The three plies will in the following be referred to as a first ply, a second ply, and a third ply. The third ply is positioned between the first ply and the second ply.

The first ply may comprise first embossments with a first height (h1), the first height (h1) being in a range of 0.2 mm to 2.0 mm. The adhesive, such as lamination glue, may be applied to tips of the first embossments of the first ply.

The second ply may comprise second embossments with a second height (h2), the second height (h2) being in a range of 0.2 mm to 2.0 mm.

The first ply may comprise third embossments with a third height (h3) smaller than the first height h1 (h1>h3).

The second ply may comprise fourth embossments with a fourth height (h4) smaller than the second height h2 (h2>h4).

According to some embodiments, the third ply is unembossed. Sometimes, the third ply (the middle ply) may be referred to as an unembossed ply. With "unembossed", it is meant that the third ply is not pre-embossed prior to the final ply-bonding being carried out. That is, the third ply may no longer be flat after the ply-bonding, but has not beforehand been embossed using an embossing roll.

According to some embodiments, the first ply and the third ply have been embossed together to form the first embossments on the first ply and the third ply.

According to some embodiments, the third embossments have been formed only on the first ply but not on the third ply. According to other embodiments, the first ply and the third ply have been embossed together to form the third embossments on the first ply and the third ply.

The third ply (i.e., the middle ply) may comprise fifth embossments with a fifth height (h5), the fifth height (h5) being in a range of 0.2 mm to 2.0 mm. The third ply may have been embossed separately from the first ply and the second ply.

Some embodiments of the coreless roll in accordance with the present disclosure comprise a tissue paper product including exactly four plies. The density of the coreless roll is in a range of 130 to 160 $kg/m^3$. The sum of the areas of all glued embossed areas is at least 6%, optionally at least 7%, or at least 8% of the sum of the areas of all glued areas and of all non-glued areas.

The tissue paper product comprises four plies. In fact, a total number of plies of the tissue paper product is four. Put differently, the tissue paper product consists of four plies. However, the latter statement does not imply that the tissue paper product cannot comprise other constituents (other than plies), such as adhesive, additives, etc. It means only that the number of plies is four. At least one of the four plies is an embossed ply. One of the four may be an embossed ply, or two of the four, three of the four, or all four plies may be embossed plies.

The coreless rolls with a tissue paper product made of four plies described above may have a particularly high radial compression strength. Specifically, the radial compression strength of such rolls may be 20N or more, or even 25N or more, or even 30N. These are robust and meet the requirements, e.g., for toilet paper rolls. This property may be increasingly promoted by the increasingly narrower ranges of grammage specified for the three-ply tissue paper product.

A caliper of the tissue paper product with four plies may be at least 0.50 mm, optionally at least 0.55 mm.

The four plies may be referred to as a first ply, a second ply, a third ply, and a fourth ply. The first ply and the second ply are the outermost plies of the tissue paper product. The third ply and the fourth ply are, hence, located between the first ply and the second ply.

The first ply may comprise first embossments with a first height (h1), the first height (h1) being in a range of 0.2 mm to 2.0 mm. The adhesive, such as lamination glue, may be applied to tips of the first embossments of the first ply.

The second ply may comprise second embossments with a second height (h2), the second height (h2) being in a range of 0.2 mm to 2.0 mm.

The first ply may comprise third embossments with a third height (h3) smaller than the first height h1 (h1>h3).

The second ply may comprise fourth embossments with a fourth height (h4) smaller than the first height h2 (h2>h4).

The first ply and the third ply may have been embossed together to form the first embossments on the first ply and the third ply.

According to some embodiments, the fourth ply is unembossed.

According to some embodiments, the fourth ply may have been embossed separately from the first ply, the second ply, and the third ply.

According to some embodiments, the third embossments are formed only on the first ply but not on the third ply. According to other embodiments, the first ply and the third ply have been embossed together to form the third embossments on the first ply and the third ply.

According to some embodiments, the first ply, the third ply, and the fourth ply have been embossed together to form the first embossments on the first ply, the third ply, and the fourth ply.

According to some embodiments, the first ply, the third ply, and the fourth ply have been embossed together to form the third embossments on the first ply, the third ply, and the fourth ply.

According to some embodiments, the first ply, the third ply, and the fourth ply have been embossed to form third embossments on the first ply and the third ply, but not on the fourth ply.

According to some embodiments, the third embossments have been formed on the first ply, but not on the third ply and the fourth ply.

According to some embodiments, the third ply and the fourth ply have been embossed together separately from the first ply and the second ply. According to other embodiments, one of the third ply and the fourth ply has been separately embossed from the first ply and the second ply, and the other one of the third ply and the fourth ply is unembossed. According to yet other embodiments, the third ply and the fourth ply are unembossed.

According to some embodiments, the first ply and the third ply have been embossed together to form the first embossments on the first ply and the third ply. In addition thereto or as an alternative thereto, the fourth ply and the second ply have been embossed together to form the second embossments on the fourth ply and the second ply.

According to some embodiments, the first ply and the third ply have been embossed together to form the third embossments on the first ply and the third ply. According to other embodiments, the third embossments have been formed only on the first ply but not on the third ply.

Another aspect of the above-mentioned object is achieved by a coreless roll of a tissue paper product, such as toilet paper, with five or six plies, in accordance with the present disclosure. The density of the coreless roll is in a range of 150 to 160 kg/m$^3$. The sum of the areas of all glued areas is at least 6%, optionally at least 7%, or at least 8% of the sum of the areas of all glued areas and of all non-glued areas.

The tissue paper product comprises five or six plies of Conventional Wet Press paper (CWP). In fact, a total number of plies of the tissue paper product is five or six. Put differently, the tissue paper product consists of five or six plies. However, the latter statement does not imply that the tissue paper product cannot comprise other constituents (other than plies), such as adhesive, additives, etc. It means only that the number of plies is five or six. At least one of the five or six plies is an embossed ply. One, two, three, four, or five (or six, if applicable) of the five or six plies may be embossed plies.

The coreless rolls with a tissue paper product made of five or six plies described above may have a particularly high radial compression strength. Specifically, the radial compression strength of such rolls may be 20N or more, or even 25N or more, or even 30N. These are robust and meet the requirements, e.g., for toilet paper rolls. This property may be increasingly promoted by the increasingly narrower ranges of grammage specified for the five- or six-ply tissue paper product.

A caliper of the tissue paper product may be at least 0.60 mm, optionally at least 0.65 mm.

At least one of the outermost plies of the tissue paper product may comprises first embossments with a first height (h1), the first height (h1) being in a range of 0.2 mm to 2.0 mm. An adhesive, such as lamination glue, may be applied to tips of the first embossments of the first ply. The other one of the outermost plies of the tissue paper product may comprise second embossments with a second height (h2), the second height (h2) being in a range of 0.2 mm to 2.0 mm.

Another aspect of this disclosure relates to a method of manufacturing a coreless roll of a tissue paper product, such as toilet paper or household towel, that comprises at least two plies. The method comprises the steps of:

feeding at least two plies and embossing at least one of the at least two plies to form an embossed ply, wherein all of the fed plies are made of Conventional Wet Press (CWP) paper;

ply-bonding the at least two plies using an adhesive, such as a lamination glue, forming glued areas and leaving non-glued areas between the glued areas, wherein at least some of the glued areas are glued embossed areas comprising embossments of the embossed ply, such that a sum of areas of all glued embossed areas is at least 6% of a sum of the areas of all glued areas and of areas of all non-glued areas, to form the tissue paper product;

spirally winding up the tissue paper product on a mandrel to form a coreless roll and to define an axially extending inner hole facing the mandrel, with a first end of the tissue paper product being located on the outer side of the coreless roll and the second end being located at the inner hole; and withdrawing the mandrel, wherein the coreless roll comprises an outer diameter in the range of from 95 to 150 mm and a diameter of the inner hole is in the range of from 20 to 50 mm, and the density of the coreless roll lies in a range of 110 to 160 kg/m$^3$;

wherein the steps of embossing and of ply-bonding are performed such that, over at least 80% of the glued embossed areas, a maximum distance between adjacent embossments of the embossed ply is 2.5 mm or less, optionally 2.0 mm or less, or 1.5 mm or less.

The coreless rolls manufactured by the method may offer the same benefits as coreless rolls described above. In other words, features of the coreless rolls of any of the embodiments described above translate into corresponding features of an embodiment of the method, and vice versa. For the sake of conciseness, benefits which may be associated with particular features of an embodiment of the product will not be discussed for the corresponding method claims, but reference is instead made on a general basis now to the respective passage of the description relating to embodiments of the apparatus.

According to some embodiments, the steps of embossing the at least one ply and of ply-bonding are performed such that, over at least 80% of the glued embossed areas, an embossment density of at least 20 embossments/cm$^2$, optionally at least 40 embossments/cm$^2$.

Embodiments of the method comprise the step of providing at least 90%, optionally 95%, of the adhesive to tips of embossments of the embossed ply.

The method may comprise the step of embossing the at least one ply with first embossments with a first embossment height and at least one further type of embossments with a height smaller than the first embossment height, and it may comprise the step of providing at least 90%, optionally 95%, of the adhesive of the adhesive to tips of the first embossments of the embossed ply in the tissue paper product.

According to some embodiments, the ply-bonding is performed to at least 80%, at least 85%, or at least 90, or at least 95% of all areas of the embossed ply which have been embossed.

The step of embossing to form the embossed ply may comprise providing at least 25, optionally at least 30 embossments to at least 80%, at least 85%, or at least 90, or at least 95% of all areas to be embossed and ply-bonded.

Any embodiment of the method in accordance with the present disclosure may comprise a step of coating at least a part of an innermost circumvolution, optionally the entire innermost circumvolution, of the tissue paper product of the coreless roll at the second end with a stabilizing coating composition. The coating step may be carried out prior to the step of winding up the tissue paper product on a mandrel.

Some embodiments of the method are for manufacturing a coreless roll of a tissue paper product comprising exactly two plies, a first ply and a second ply. The density of the coreless rolls manufactured by these embodiments are in a range of 110 to 150 kg/m$^3$, the sum of the areas of all glued embossed areas is at least 6%, optionally at least 7% or at least 8% or at least 9%, of the sum of the areas of all glued areas and of all non-glued areas.

A caliper of the tissue paper product may be at least 0.35 mm, optionally at least 0.40 mm or at least 0.45 mm. A grammage of the tissue paper product optionally being in a range of from 24 g/m$^2$ to 50 g/m$^2$, optionally 30 g/m$^2$ to 45 g/m$^2$.

The tissue paper products manufactured by the method may have the same benefits as the tissue paper products with two plies described above. In other words, features of the tissue paper products of any of the embodiments described above translate into corresponding features of an embodiment of the method, and vice versa. For the sake of conciseness, benefits which may be associated with particular features of an embodiment of the product will not be discussed for the corresponding method claims, but reference is instead made on a general basis now to the respective passage of the description relating to embodiments of the product.

The method may comprise embossing the first ply and the second ply, i.e., both plies may be embossed plies.

According to some embodiments, the method comprises the steps of:

embossing the first ply with a first embossing roll with first embossing protrusions to form first embossments with a first height (h1) in a range of 0.2 mm to 2.0 mm; and embossing the second ply with a second embossing roll with second embossing protrusions to form second embossments with a second height (h2) in a range of 0.2 mm to 2.0 mm.

According to some embodiments, the first embossing roll also comprises third embossing protrusions, and the step of embossing the first ply forms first and third embossments on the first ply. According to other embodiments, the method comprises a step of embossing the first ply with a third embossing roll with third embossing protrusions to form third embossments. In other words, a second type of embossments may be formed on the first ply either with one and the same embossment roll as used for the first embossments, or they may be formed with another embossing roll.

Analogous statements hold for yet further types of embossments (different types referring to embossments with different shapes and/or different embossment heights, etc.).

The height of the third embossments h3 may be smaller than the height of the first embossments h1 (h1>h3).

Adhesive, such as lamination glue, may be applied primarily (e.g., to a degree of 85%, 90%, or 95) or exclusively (in the sense of only) to tips of the first embossments of the first ply (in as far as the application of adhesive to the first ply is concerned).

According to some embodiments, the second embossing roll also comprises fourth embossing protrusions, and the step of embossing the second ply forms second and fourth embossments on the third ply. According to other embodiments, the method comprises a step of embossing the second ply with a fourth embossing roll with fourth embossing protrusions to form fourth embossments. In other words, a second type of embossments may be formed on the second ply either with one and the same embossment roll as used for the second embossments, or they may be formed with another embossing roll.

Analogous statements hold for yet further types of embossments (different types referring to embossments with different shapes and/or different embossment heights, etc.).

The height of the fourth embossments h4 may be smaller than the height of the second embossments h2 (h2>h4).

Adhesive, such as lamination glue, may be applied primarily (e.g., to a degree of 85%, 90%, or 95) or exclusively (in the sense of only) to tips of the second embossments of the second ply (in as far as the application of adhesive to the second ply is concerned).

Another aspect of this disclosure relates to a method of manufacturing a coreless roll of a tissue paper product, such as toilet paper, the tissue paper product being made of three plies. The (at least one) embossed ply is an outermost ply. The density of the coreless rolls in accordance with these embodiments lie in a range of 130 to 160 kg/m$^3$. The sum of the areas of all glued embossed areas is at least 6%, optionally at least 7%, or at least 8% of the sum of the areas of all glued areas and of all non-glued areas.

The tissue paper products manufactured by the method may have analogous benefits as the tissue paper products with three plies described above. In other words, features of the tissue paper products of any of the embodiments described above translate into corresponding features of an embodiment of the method, and vice versa. For the sake of conciseness, benefits which may be associated with particular features of an embodiment of the product will not be discussed for the corresponding method claims, but reference is instead made on a general basis now to the respective passage of the description relating to embodiments of the product.

The caliper of the manufactured tissue paper product may be at least 0.40 mm, or at least 0.45 mm, or at least 0.50 mm.

The grammage of the tissue paper product may be in a range of from 34 g/m$^2$ to 65 g/m$^2$, optionally 40 g/m$^2$ to 63 g/m$^2$, or 45 g/m$^2$ to 60 g/m$^2$.

According to some embodiments, the method comprises the steps of:

embossing the first ply with a first embossing roll with first embossing protrusions to form first embossments with a first height (h1) in a range of 0.2 mm to 2.0 mm; and embossing the second ply with a second embossing roll with second embossing protrusions to form second embossments with a second height (h2) in a range of 0.2 mm to 2.0 mm;

wherein the first, second, and third plies are ply-bonded such that the third ply is located between the first ply and the second ply.

According to some embodiments, the first embossing roll also comprises third embossing protrusions, and the step of embossing the first ply forms first and third embossments on the third ply. According to other embodiments, the method comprises a step of embossing the first ply with a third embossing roll with third embossing protrusions to form third embossments. In other words, a second type of embossments may be formed on the first ply either with one and the same embossment roll as used for the first embossments, or they may be formed with another embossing roll. Analogous statements hold for yet further types of embossments (different types referring to embossments with different shapes and/or different embossment heights, etc.).

According to some embodiments, the second embossing roll also comprises fourth embossing protrusions, and the step of embossing the second ply forms second and fourth embossments on the second ply. According to other embodiments, the method comprises a step of embossing the second ply with a fourth embossing roll with fourth embossing protrusions to form fourth embossments. In other words, a second type of embossments may be formed on the second ply either with one and the same embossment roll as used for the second embossments, or they may be formed with another embossing roll. Analogous statements hold for yet further types of embossments (different types referring to embossments with different shapes and/or different embossment heights, etc.).

The adhesive, such as lamination glue, may be applied, e.g., to parts of the third ply to be bonded to tips of the first embossment of the first ply. Alternatively or in addition thereto, adhesive may be applied, e.g., to tips of the first embossments, and/or second embossments, and/or third embossments, and/or fourth embossments.

According to some embodiments, the method not comprising a step of embossing the third ply. In other words, the third ply may not be pre-embossed prior to the final ply-bonding. In this sense, the third ply may, in the case of these embodiments, also be referred to, e.g., as a flat middle ply.

Embodiments of the method may comprise the step of embossing the first ply and the third ply together to form the first embossments on the first ply and the third ply.

According to some embodiments, the third embossments are formed only on the first ply but not on the third ply. According to other embodiments, the first ply and the third ply are embossed together to form the third embossments on the first ply and the third ply.

The method may comprise the step of embossing the third ply to form fifth embossments with a fifth height (h5), the fifth height (h5) being in a range of 0.2 mm to 2.0 mm, wherein the third ply has been embossed separately from the first ply and the second ply.

Some embodiments of the method manufacture a coreless roll of a tissue paper product comprising exactly four plies, wherein the density of the coreless roll is in a range of 130 to 160 kg/m$^3$, and the sum of the areas of all glued embossed areas is at least 6%, optionally at least 7%, or at least 8% of the sum of the areas of all glued areas and of all non-glued areas.

The tissue paper products manufactured by the method may have analogous benefits as the tissue paper products with four plies described above. In other words, features of the tissue paper products of any of the embodiments described above translate into corresponding features of an embodiment of the method, and vice versa. For the sake of conciseness, benefits which may be associated with particular features of an embodiment of the product will not be discussed for the corresponding method claims, but reference is instead made on a general basis now to the respective passage of the description relating to embodiments of the product.

A caliper of the tissue paper product comprising exactly four plies may be at least 0.50 mm, optionally at least 0.55 mm.

In the following, the four plies of the four ply-embodiments will be referred to as a first ply, a second ply, a third ply, and a fourth ply, wherein the first ply and the second ply are outermost plies of the tissue paper product.

Embodiments of the method comprise the steps of:

embossing the first ply to form first embossments with a first height (h1), the first height (h1) being in a range of 0.2 mm to 2.0 mm; and embossing the second ply to form second embossments with a second height (h2), the second height (h2) being in a range of 0.2 mm to 2.0 mm.

According to some embodiments, the adhesive, such as lamination glue, may be applied to the third ply and/or fourth ply, for example, at parts facing to be bonded to tips of the first embossments of the first ply and/or tips of the second embossments of the second ply. In addition or alternatively thereto, the adhesive may, e.g., applied to tips of the first embossments of the first ply and/or tips of the second embossments of the second ply.

The method may comprise embossing the first ply to form third embossments with a third height (h3) smaller than the first height (h1) (h1>h3).

The method may comprise embossing the second ply to form fourth embossments with a fourth height (h4) smaller than the second height (h2) (h2>h4).

According to some embodiments, the first ply and the third ply are embossed together to form the first embossments on the first ply and the third ply.

The method may not comprise a step of embossing the fourth ply, or the method may comprise a step of embossing the fourth ply separately from the first ply, the second ply, and the third ply.

The method may comprise the step of forming the third embossments only on the first ply but not on the third ply, or of embossing the first ply and the third ply together to form the third embossments on the first ply and the third ply.

Some embodiments comprise the step of embossing the first ply, the third ply, and the fourth ply together to form the first embossments on the first ply, the third ply, and the fourth ply.

According to some embodiments, the first ply, the third ply, and the fourth ply are embossed together to form the third embossments on the first ply, the third ply, and the fourth ply. According to embodiments, the third embossments are formed on the first ply and the third ply, but not on the fourth ply. According to other embodiments, the third embossments are formed on the first ply, but not on the third ply and the fourth ply.

According to some embodiments, the third ply and the fourth ply are embossed together separately from the first ply and the second ply, or one of the third ply and the fourth ply is embossed separately from the first ply and the second ply, and the other one of the third ply and the fourth ply is not embossed. According to other embossed, neither the third ply nor the fourth ply is embossed (in the sense of being pre-embossed before the final ply-bonding is carried out.

According to some embodiments, the first ply and the third ply are embossed together to form the first embossments on the first ply and the third ply. The fourth ply and the second ply may be embossed together to form the second embossments on the fourth ply and the second ply.

According to some embodiments, the first ply and the third ply are embossed together to form the third embossments on the first ply and the third ply, or the third embossments are formed only on the first ply but not on the third ply.

Some embodiments of the method manufacture a coreless roll of a tissue paper product comprising exactly five or six plies, wherein the density of the core less roll is in a range of 150 to 160 kg/m$^3$, and the sum of the areas of all glued areas is at least 6%, optionally at least 7%, or at least 8% of the sum of the areas of all glued areas and of all non-glued areas.

The tissue paper products manufactured by the method may have analogous benefits as the tissue paper products with five or six plies described above. In other words, features of the tissue paper products of any of the embodiments described above translate into corresponding features of an embodiment of the method, and vice versa. For the sake of conciseness, benefits which may be associated with particular features of an embodiment of the product will not be discussed for the corresponding method claims, but reference is instead made on a general basis now to the respective passage of the description relating to embodiments of the product.

A caliper of the tissue paper product may be at least 0.60 mm, optionally at least 0.65 mm.

According to some embodiments, at least one of the outermost plies of the tissue paper product may be embossed to form first embossments with a first height (h1), the first height (h1) being in a range of 0.2 mm to 2.0 mm; and the other one of the outermost plies of the tissue paper product is embossed to form second embossments with a second height (h2), the second height (h2) being in a range of 0.2 mm to 2.0 mm.

According to some embodiments, the adhesive, such as lamination glue, may be applied to a third ply (e.g., a ply neighboring the first ply) and/or a fourth ply (e.g., a ply neighboring the second ply), for example, at parts facing to be bonded to tips of the first embossments of the first ply and/or tips of the second embossments of the second ply. In addition or alternatively thereto, the adhesive may, e.g., applied to tips of the first embossments of the first ply and/or tips of the second embossments of the second ply.

Another aspect of this disclosure relates to a coreless roll of a tissue paper product manufactured according to any one of the above-described embodiments.

Moreover, this disclosure relates to a coreless roll of a tissue paper product, such as toilet paper or household towel, made of a spirally wound continuous web of tissue paper having a first end and a second end, the web of absorbent material being wound such as to define an axially extending inner hole centrally positioned relative to the coreless roll and such that the first end is located on the outer side of the coreless roll and the second end is located at the inner hole. The tissue paper product comprises at least two plies, wherein all of the plies of the tissue paper product are made of Conventional Wet Press paper (CWP). The at least two plies include at least a first ply and a second ply, being the outermost plies of the tissue paper product.

The coreless roll has an outer diameter in the range of from 95 to 150 mm, a diameter of the inner hole being in the range of from 20 to 50 mm, and the density of the coreless roll being in a range of 110 to 160 kg/m$^3$. The first ply is embossed with first embossments and the second ply is embossed with second embossments.

The tissue paper product comprising glued areas, where the plies are ply-bonded to each other using an adhesive, such as a lamination glue, and non-glued areas between the glued areas.

At least some of the glued areas are glued embossed areas that comprise first embossments of the first ply and second embossments of the second ply.

A sum of areas of all glued embossed areas is at least 6% of a sum of the areas of all glued areas and of areas of all non-glued areas.

For the manufacturing of such embodiments, a double lamination unit may be used. In other words, two adhesive applying units may be used during the process of manufacturing such embodiments. For example, adhesive may be provided such that it is present both at tips of embossments of the first ply as well as at tips of embossments of the second ply (irrespective of whether the adhesive is applied to the first ply and/or second ply or a ply to be ply-bonded therewith, respectively).

The coreless rolls with a tissue paper product in accordance with the present disclosure may have a particularly high radial compression strength. Specifically, the radial compression strength of such rolls may be 20N or more, or even 25N or more, or even 30N. These are robust and meet the requirements, e.g., for toilet paper rolls. Thus, they may achieve customer satisfaction. In particular, the criteria of having a ratio of at least 6% of glued embossed areas in conjunction with the presence of embossments on the first ply and on the second ply in the glued embossed areas may, in particular, promote the high radial compression strength.

If the sum of the areas of all glued embossed areas is lower than 6% of the sum of the areas of all glued areas and of the areas of all non-glued areas, the glued embossments may have to be spread out too much for being able to promote a satisfactory integrity of the products (in the sense of promoting a satisfactorily high radial compression strength) without impairing the thickness and/or desirably large caliper of the tissue paper product and/or sufficiently high softness. Trying to concentrate the embossments sufficiently to have a sufficiently strong bonding and to sufficiently promote a large radial compression strength, despite the sum of the areas of all glued embossed areas being lower than 6% of the sum of the areas of all glued areas and of the areas of all non-glued areas, may not be possible due to technical reasons relating to engravement. The necessary maximum distances between adjacent embossments may otherwise no longer be maintained.

According to some embodiments, a maximum distance between adjacent embossments of the embossed ply is, over at least 80% of the glued embossed areas, 2.5 mm or less, optionally 2.0 mm or less, or 1.5 mm or less.

Additional advantages and features of the present disclosure, that can be realized on their own or in combination with one or several features discussed above, insofar as the features do not contradict each other, will become apparent from the following description of particular embodiments.

BRIEF DESCRIPTION OF THE DRAWINGS

For a better understanding of the present disclosure and to show how the same may be carried into effect, reference will now be made, by way of example only, to the accompanying drawings, in which:

The description is given with reference to the accompanying drawings, in which:

FIG. 1 is a schematic representation of an embodiment of a coreless roll 1 in accordance with the present disclosure.

Figure 1:
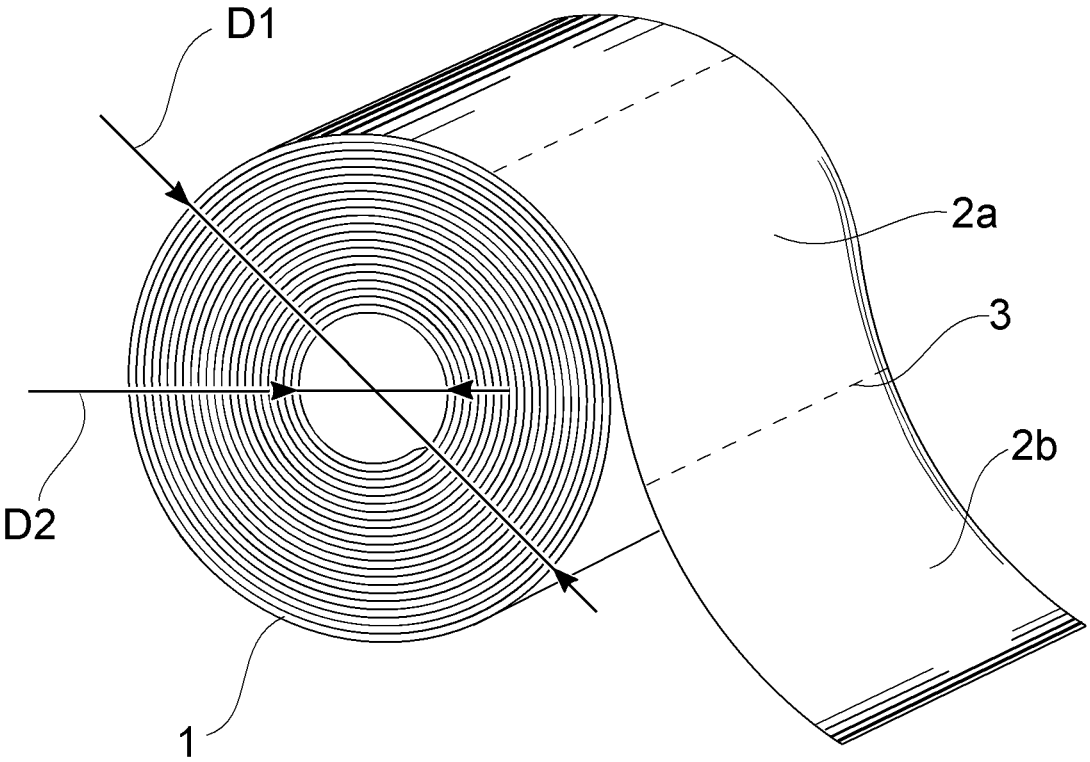
FIG. 1 is a perspective view of a coreless roll in accordance with the present disclosure.

The coreless roll 1 of FIG. 1 represents different embodiments, i.e., embodiments of coreless rolls comprising different tissue paper products with two, three, four, five, or six plies. All of the plies of these embodiments are made of Conventional Wet Press (CWP) paper).

The embodiments of FIG. 1 are toilet paper rolls comprising a tissue paper product that comprises different sheets 2*a*, 2*b* which can be easily separated along a perforation line 3. However, other embodiments may not comprise such perforation lines.

The coreless roll 1 of FIG. 1 is made of a spirally wound continuous web of tissue paper product having a first end and a second end, the web of tissue paper product being wound such as to define an axially extending inner hole centrally positioned relative to the coreless roll 1 and such that the first end is located on the outer side of the coreless roll 1 and the second end is located at the inner hole.

The outer diameter D1 of the coreless roll 1 is in a range of 95 to 150 mm. The diameter D2 of the inner hole of the roll 1 is in a range of 20 to 50 mm. The density of the coreless roll 1 is in a range of 110 to 160 kg/m$^3$ (narrower ranges for the respective numbers of plies of the tissue paper products are indicated above).

The tissue paper product of the embodiments of FIG. 1 is ply-bonded using an adhesive (a lamination glue). The areas where the plies are ply-bonded can be referred to as glued areas. Between glued areas, there are non-glued areas (areas where the plies are not glued together).

Specifically, at least one of the plies of the tissue paper product of the coreless roll 1 of FIG. 1 has been embossed with an embossing roll. The glue for ply-bonding largely resides in regions of the tissue paper products where embossments are provided on the embossed ply. The areas which are glued areas and also comprise embossments are in the following referred to as glued embossed areas. In so far, the glued embossed areas may also be a subset of the embossed areas of the ply in question.

The embossments on the embossed ply are even present with a minimum density over at least 80% of the glued embossed areas, i.e., a maximum distance between adjacent embossments of the embossed ply is 2.5 mm or less over at least 80% of the total of the sum of all surface of the glued embossed areas. Moreover, a sum of areas of all glued embossed areas of the tissue paper product is at least 6% of a sum of the areas of all glued areas and of areas of all non-glued areas.

The radial compression strength of the coreless rolls 1 of FIG. 1 is at least 30N or more. However, according to other embodiments, it is at least 20N or more or at least 25N or more. This provides robustness to a toilet paper roll (e.g., to achieve customer satisfaction, but also for packing purposes, etc.) and is achieved despite the fact the roll 1 is coreless. As the roll is coreless, waste is reduced, and the roll in question may be considered as environment-friendly.

FIGS. 2A to 9C will be used to explain properties of tissue paper products of embodiments of coreless rolls in accordance with the present disclosure. In particular, explanations will be provided on the embossing patterns used for embossing at least one ply which has embossments in glued embossed areas. The large radial compression strengths of coreless rolls in accordance with the present disclosure may be largely attributed to the presence of glued embossed areas (to the dense distribution of embossments on these areas by respecting a maximum distance threshold between adjacent embossments over at least 80% of the total surface of glued embossed areas) and to their distribution (as a sum of areas of all glued embossed areas of the tissue paper product is at least 6% of a sum of the areas of all glued areas and of areas of all non-glued areas).

Figure 2A:
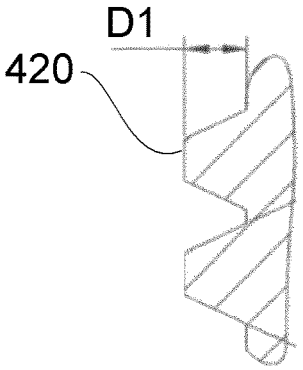
FIG. 2A is a sectional view of embossing protrusions of an embossing roll used to manufacture a tissue paper product of a first embodiment of a coreless roll in accordance with the present disclosure.
Figure 2B:
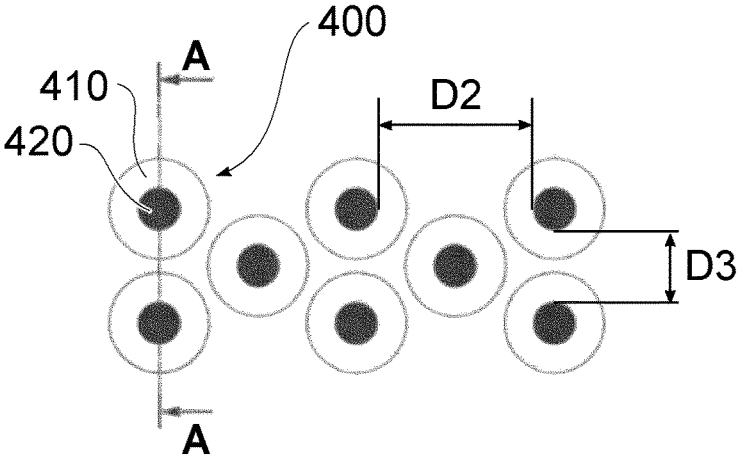
FIG. 2B is a top view of the embossing protrusions of FIG. 2A.

FIG. 2A is a sectional view of embossing protrusions 400 of an embossing roll used to manufacture a tissue paper product of a first embodiment of a coreless roll in accordance with the present disclosure. FIG. 2B is a top view of the embossing protrusions 400 of FIG. 2A.

In the case of the embodiment of FIGS. 2A and 2B, a height of the embossing protrusions D1 may, e.g., be in a range of 0.1 mm to 2.0 mm.

The top view of FIG. 2B illustrates distances between adjacent protrusions D4 in an up-down-direction. The distance D3 may, e.g., for this embodiment, e.g., be in a range of 1.0 mm to 2.5 mm. The distance between protrusions in an orthogonal direction D2 may, e.g., in the case of this embodiment be in a range of 1.0 mm to 3.5 mm. Reference sign 420 in FIG. 2B again illustrates embossment tips, while reference sign 410 denotes a base portion of an embossing protrusion. The line A-A in FIG. 2B is the section shown in FIG. 2A.

Figure 3A:
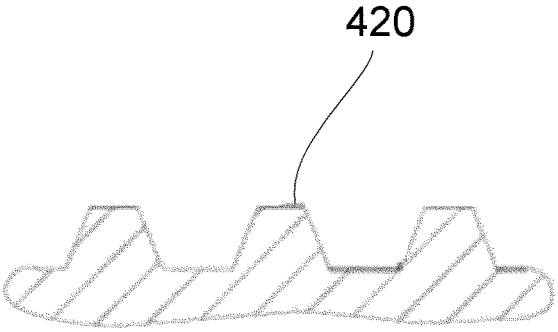
FIG. 3A is a sectional view along a first intersection direction of embossing protrusions of an embossing roll used to manufacture a tissue paper product of a second embodiment of a coreless roll in accordance with the present disclosure.
Figure 3B:
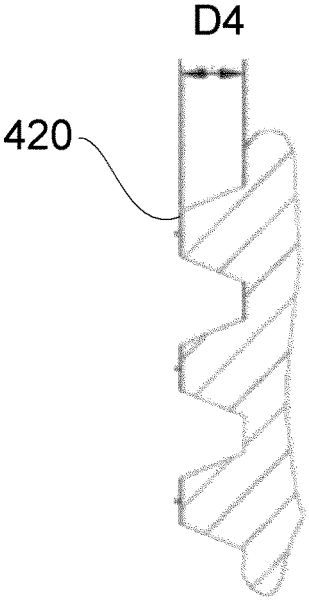
FIG. 3B is a sectional view along a second intersection direction of the embossing protrusions of FIG. 3A.

FIG. 3A is sectional view along a first intersection direction of embossing protrusions 400 of an embossing roll used to manufacture a tissue paper product of a second embodiment in accordance with the present disclosure. FIG. 3B shows a sectional view along a second intersection direction of the embossing protrusions of FIG. 3A. Distances between adjacent protrusions may, in the case of this embodiment, be in a range of 1.0 mm to 2.5 mm. In the case of the embodiment of FIGS. 3A-3C, a height D4 of the embossing protrusions may, e.g., be in a range of 0.1 mm to 2.0 mm.

Figure 3C:
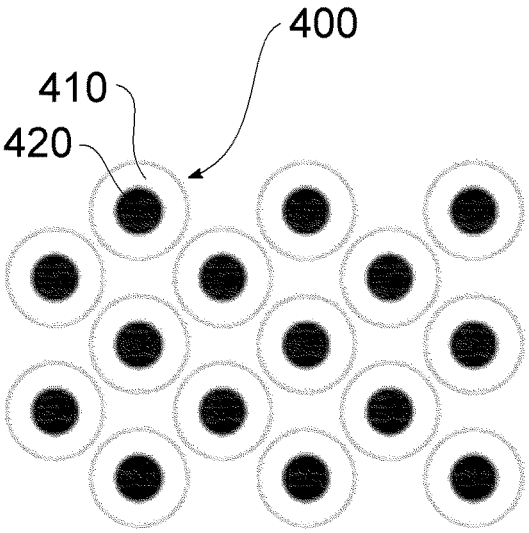
FIG. 3C is a top view of the embossing protrusions of FIGS. 3A and 3B.

FIG. 3C is a top view of the embossing protrusions of FIGS. 3A and 3B. Embossment protrusions 400 are illustrated to comprise tips 420 as well as base parts 410. The distance between the tips 420 is what corresponds to the distance between corresponding protrusions of an embossed ply.

Figure 4B:
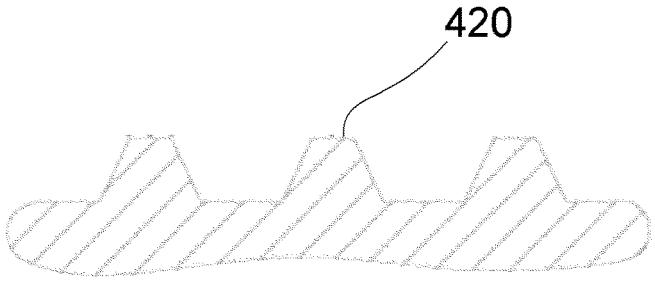
FIG. 4B is a sectional view along a second intersection direction of the embossing protrusions of FIG. 4A.
Figure 4A:
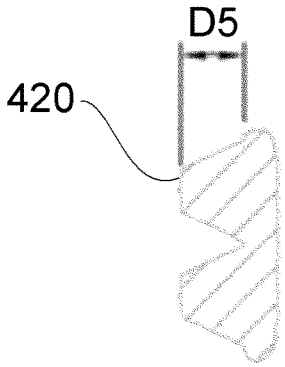
FIG. 4A is a sectional view along a first intersection direction of embossing protrusions of an embossing roll used to manufacture a tissue paper product of a third embodiment of a coreless roll in accordance with the present disclosure.

FIG. 4A is sectional view along a first intersection direction of embossing protrusions 400 of an embossing roll used to manufacture a tissue paper product of a third embodiment in accordance with the present disclosure. FIG. 3B shows a sectional view along a second intersection direction of the embossing protrusions of FIG. 3A.

Figure 4C:
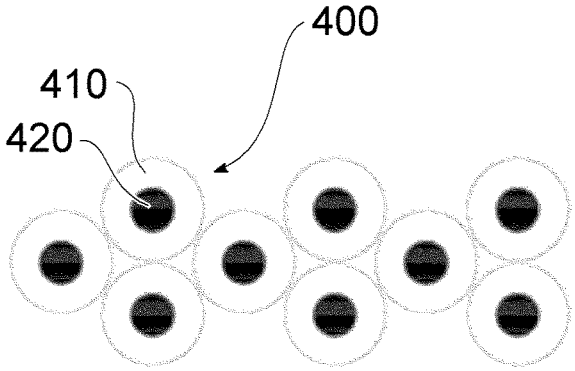
FIG. 4C is a top view of the embossing protrusions of FIGS. 4A and 4B.

In the case of the embodiment of FIGS. 4A-4C, a height D5 of the embossing protrusions may, e.g., be in a range of 0.1 mm to 2.0 mm. Distances between adjacent protrusions may, in the case of this embodiment, be in a range of 1.0 mm to 2.5 mm.

FIG. 4C is a top view of the embossing protrusions of FIGS. 4A and 4B. Embossment protrusions 400 are illustrated to comprise tips 420 as well as base parts 410. The distance between the tips 420 is what corresponds to the distance between corresponding protrusions of an embossed ply.

Figure 5A:
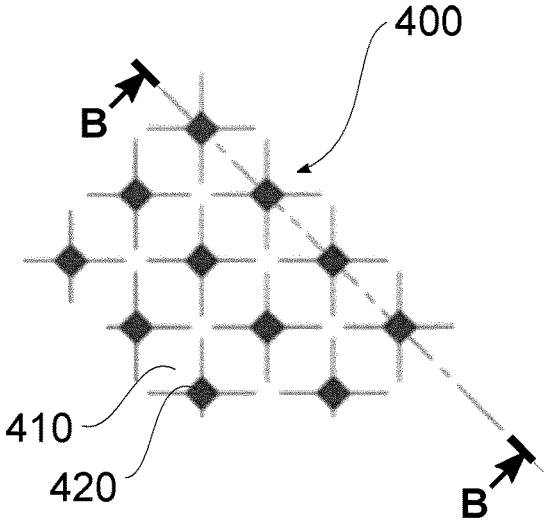
FIG. 5A is a top view of embossing protrusions of an embossing roll used to manufacture a tissue paper product of fourth embodiment of a coreless roll in accordance with the present disclosure.
Figure 5B:
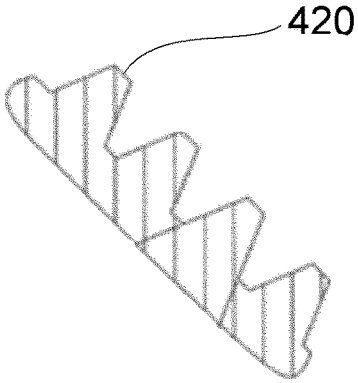
FIG. 5B is a sectional view of the embossing protrusions of FIG. 5A.

FIG. 5A is a top view of embossing protrusions of an embossing roll used to manufacture a tissue paper product of a fourth embodiment in accordance with the present disclosure. FIG. 5B is a sectional view of the embossing protrusions of FIG. 5A.

The embossment tips 420 of the protrusions 400 have a quadratic shape (as opposed to the circular shape of the above-described embodiments). The protrusions 400 thus comprise correspondingly shaped base parts 410.

Distances between adjacent protrusions may, in the case of this embodiment, be in a range of 1.0 mm to 2.5 mm.

FIG. 5B illustrates a section along the line B-B of FIG. 5A.

Figure 6A:
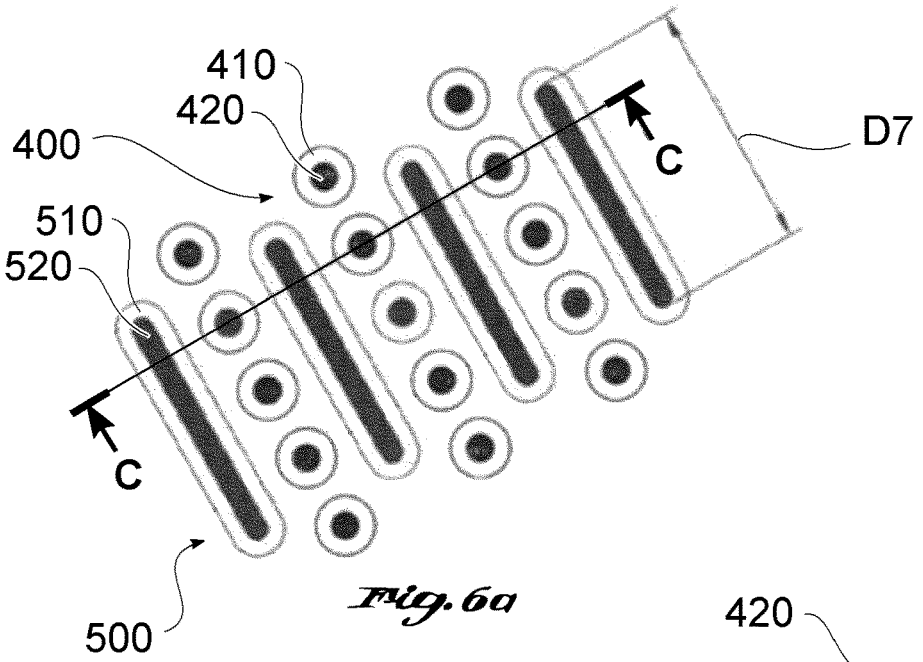
FIG. 6A is a top view of embossing protrusions of an embossing roll used to manufacture a tissue paper product of a fifth embodiment of a coreless roll in accordance with the present disclosure.
Figure 6B:
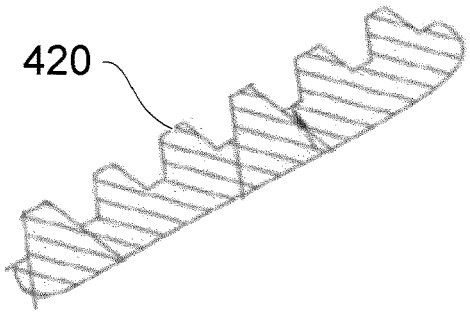
FIG. 6B is a sectional view of the embossing protrusions of FIG. 6A.

FIG. 6A is a top view of embossing protrusions of an embossing roll used to manufacture a tissue paper product of a fifth embodiment in accordance with the present disclosure. FIG. 6B is a sectional view of the embossing protrusions of FIG. 6A.

In fact, the embodiment of FIG. 6 comprises first embossing protrusions 400 with tips 420 and base parts 410, as well as second embossing protrusions 500 with tips 520 and base parts 510. The tips 420 are circular-shaped while the tips 520 are extended in a direction. The length D20 of the tips 520 may, e.g., be in a range of 3.0 mm to 8.0 mm. However, these values are by no means limiting.

FIG. 6B shows a section along the line C-C in FIG. 6A.

Figure 7A:
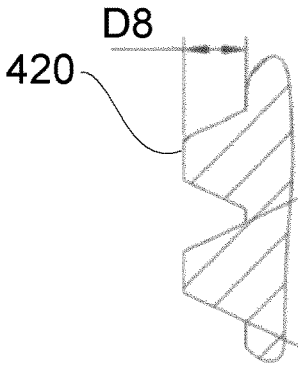
FIG. 7A is a sectional view of embossing protrusions of an embossing roll used to manufacture a tissue paper product of a sixth embodiment of a coreless roll in accordance with the present disclosure.

FIG. 7A is a sectional view of embossing protrusions of an embossing roll used to manufacture a tissue paper product of a sixth embodiment in accordance with the present disclosure.

Figure 7B:
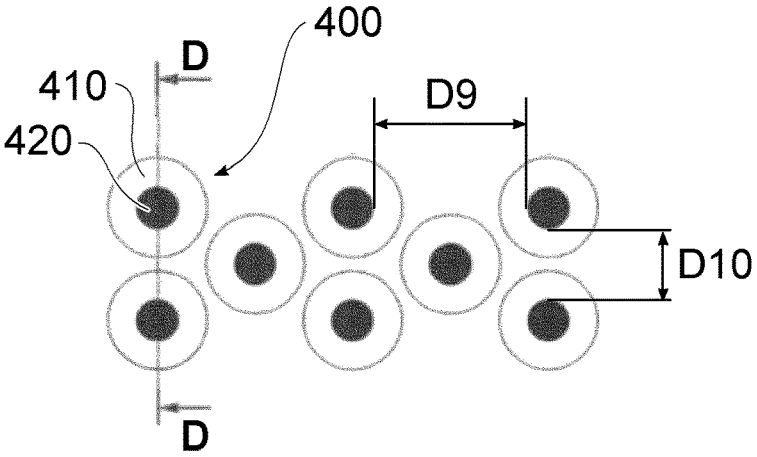
FIG. 7B is a top view of the embossing protrusions of FIG. 7A.

FIG. 7B is a top view of the embossing protrusions of FIG. 7A.

In the case of the embodiment of FIGS. 7A and 7B, a height D8 of the embossing protrusions may, e.g., be in a range of 0.1 mm to 2.0 mm. Maximum distances D10 between adjacent protrusions may, in the case of this embodiment, be in a range of 1.0 mm to 2.5 mm. Other distances D9 between protrusions may be higher than the distance D10.

Figure 8A:
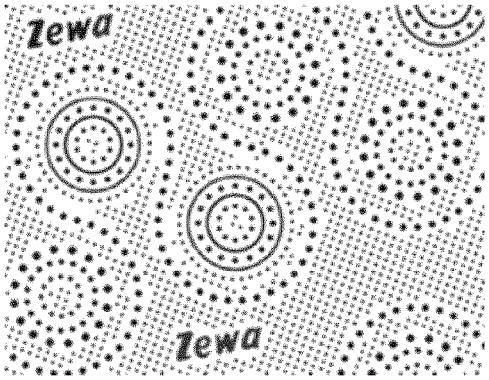
FIG. 8A is a top view of a tissue paper product of an embodiment of a coreless roll in accordance with the present disclosure.

FIG. 8A is a top view of a tissue paper product of a coreless roll in accordance with the present disclosure. The embossments are arranged in circular shapes, with a wavy line tying adjacent circular regions together. In fact, the circular regions as well as the connecting wavy line are embossed glued regions in the case of this embodiment. Moreover, logos are embossed ("Zewa" in the case of this embodiment). Over 80% of the glued embossed areas, a maximum distance between adjacent embossments is lower than 2.5 mm. Over the remaining 20%, there may be some logos, micro-embossments or decorative patterns which do not comply with the maximum distance of 2.5 mm (i.e., distances may be higher).

A sum of areas of all glued embossed areas is in the case of this embodiment well above of 6% of a sum of the areas of all glued areas and of areas of all non-glued areas (including the areas with the logos, which are part of the non-glued areas in the case of this embodiment).

Figure 8B:
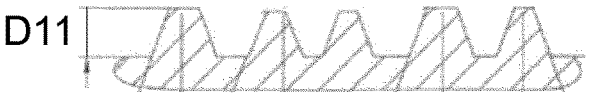
FIG. 8B is a sectional view of embossing protrusions of an embossing roll used to manufacture the tissue paper product of FIG. 8A.

FIG. 8B is a sectional view of embossing protrusions of an embossing roll used to manufacture the tissue paper product f FIG. 8A.

Figure 9A:
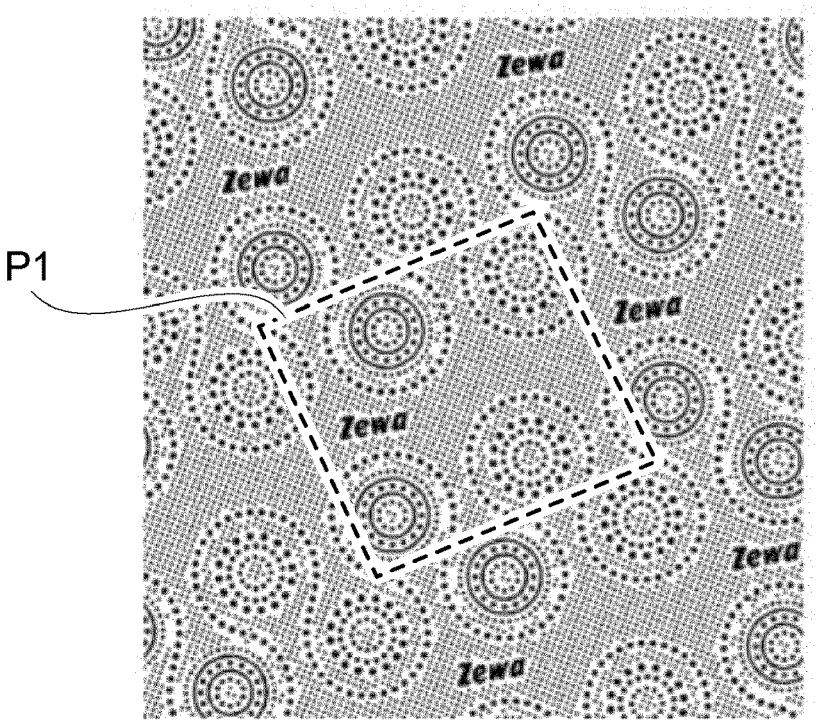
FIG. 9A is a top view of a tissue paper product of an embodiment of a coreless roll in accordance with the present disclosure.

FIG. 9A illustrates a surface area of a tissue paper product of a coreless roll in accordance with the present disclosure and, in particular, how a sample unit is singled out from the surface area.

Evidently, the glued embossed areas of the tissue paper product of FIG. 9A are arranged in a repetitive pattern, the repetitive pattern repeating a repeating unit in a direction of a length extension of the tissue paper product along the roll, a sample unit of the tissue paper product being a section with a minimum length in the direction of the length extension that comprises one repeating unit.

Figure 9B:
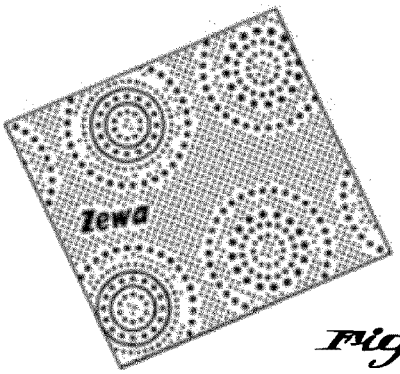
FIG. 9B illustrates a sample unit of the tissue paper product of FIG. 9A.
Figure 9C:
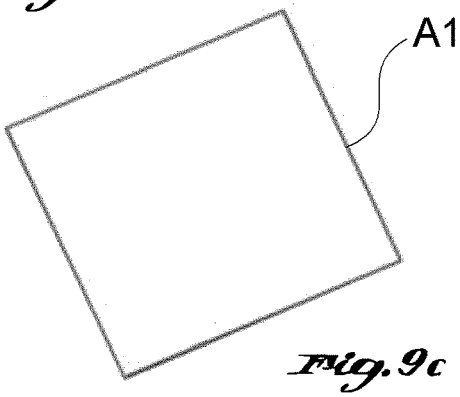
FIG. 9C shows the surface of a sample unit, which corresponds to a sum of all glued areas and all non-glued areas in the sample unit.

The sample unit is shown separately in FIG. 9B, and FIG. 9C illustrates its total area A1. The sum of the areas of all glued embossed areas is at least 6% of the sum of the areas of all glued areas and of all non-glued areas in the sample unit, said latter sum being A1 in the case of FIG. 9C.

Figure 10:
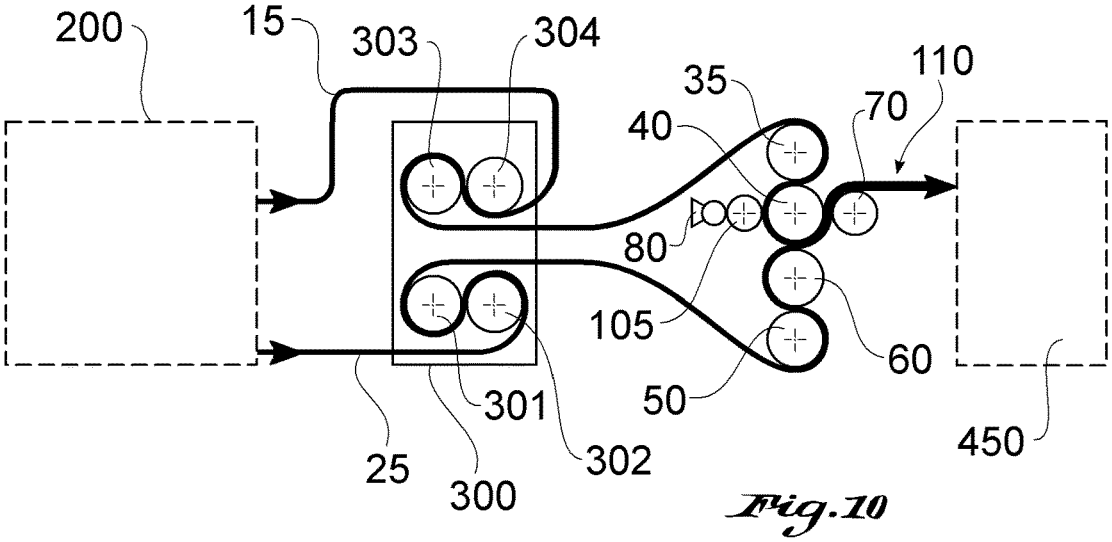
FIG. 10 is a schematic representation of (a part of) and embodiment of a manufacturing apparatus for manufacturing a coreless roll in accordance with the present disclosure with a first embodiment of a method in accordance with the present disclosure.

FIG. 10 is a schematic representation of (a part of) and embodiment of a manufacturing apparatus for manufacturing a coreless roll in accordance with the present disclosure using a first embodiment of a method in accordance with the present disclosure.

The box 200 in FIG. 10 schematically represents any constituents of the manufacturing apparatus that are used prior to the later stages illustrated in more detail. For example, the box 200 may involve unwinding rolls for unwinding a first ply 15 and a second ply 25.

According to an embodiment of the method in accordance with the present disclosure relying on the machinery manufacturing apparatus of FIG. 10, a first ply 15 and second ply 25 are supplied to a pre-embossing station 300. The pre-embossing station 300 comprises rolls 303 and 304 for pre-embossing the first ply 15 and rolls 301 and 302 for pre-embossing the second ply 25.

The first ply 15 is then conveyed towards the main embossing and ply bonding station. The first ply is, in particular, embossed between the embossing roll 40 and the counter roll 35. An adhesive supplying unit with a glue chamber 80 is provided adjacent to the embossing roll 40. An applicator roll 105 is used to homogeneously transfer adhesive (dosed by cavities engraved in an anilox roll positioned between the glue chamber 80 and the applicator roll 105) to the first ply 15 prior to the final ply-bonding being carried out.

The second ply 25 is conveyed towards the rolls 50 and 60 and is embossed between the embossing roll 60 and the counter roll 50. Ply-bonding of the first ply 15 and the second ply 25 is carried out between the embossing roll 40 and a marrying roll 70. The ply-bonded tissue paper product 110 comprising (at least two plies) is then conveyed further.

The box 450 represents any components of the manufacturing apparatus of FIG. 10 used subsequently to the steps described so far. In particular, the box 450 may comprise a winding unit for winding up the manufactured tissue paper product 110.

Figure 11:
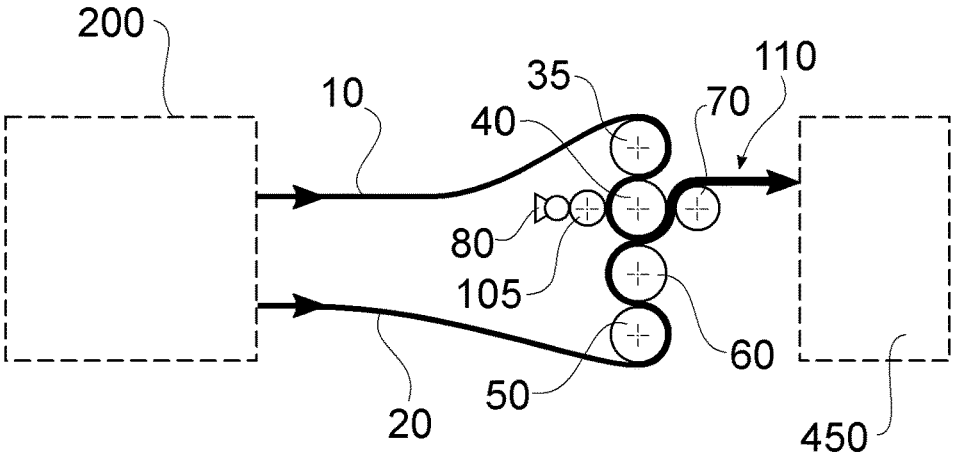
FIG. 11 is a schematic representation of (a part of) and embodiment of a manufacturing apparatus for manufacturing a coreless roll in accordance with the present disclosure with a second embodiment of a method in accordance with the present disclosure.

FIG. 11 is a schematic representation of (a part of) and embodiment of a manufacturing apparatus for manufacturing a coreless roll in accordance with the present disclosure using a second embodiment of a method in accordance with the present disclosure.

The box 200 in FIG. 11 schematically represents any constituents of the manufacturing apparatus that are used prior to the later stages illustrated in more detail. For example, the box 200 may involve unwinding rolls for unwinding a first ply 10 and a second ply 20.

According to an embodiment of the method in accordance with the present disclosure relying on the apparatus of FIG. 11, a first ply 10 and a second ply 20 are supplied. The apparatus of FIG. 11 does not comprise a pre-embossing station.

The first ply 10 is conveyed towards the rolls 35 and 40 and is embossed between the embossing roll 40 and the counter roll 35. Also in the case of the embodiment of FIG. 11, an adhesive supplying unit with a glue chamber 80 is provided adjacent to the roll 40. An applicator roll 105 is used to homogeneously transfer adhesive (dosed by cavities engraved in an anilox roll positioned between the glue chamber 80 and the applicator roll 105) to the first ply 10 prior to ply-bonding being effected.

The second ply 20 is embossed between the embossing roll 60 and the counter roll 50.

Subsequently, ply-bonding of the first ply 15 and the second ply 25 is carried out between the embossing roll 40 and a marrying roll 70. The ply-bonded tissue paper product 110 is then conveyed further.

The box 450 represents any components of the manufacturing apparatus of FIG. 3 carried out subsequently to what has been described above. In particular, the box 450 may comprise a winding unit for winding up the produced tissue paper product 110.

The difference between the apparatus of FIG. 10 and the one of FIG. 11 is that the former comprises a pre-embossing station, while the latter does not.

Figure 12:
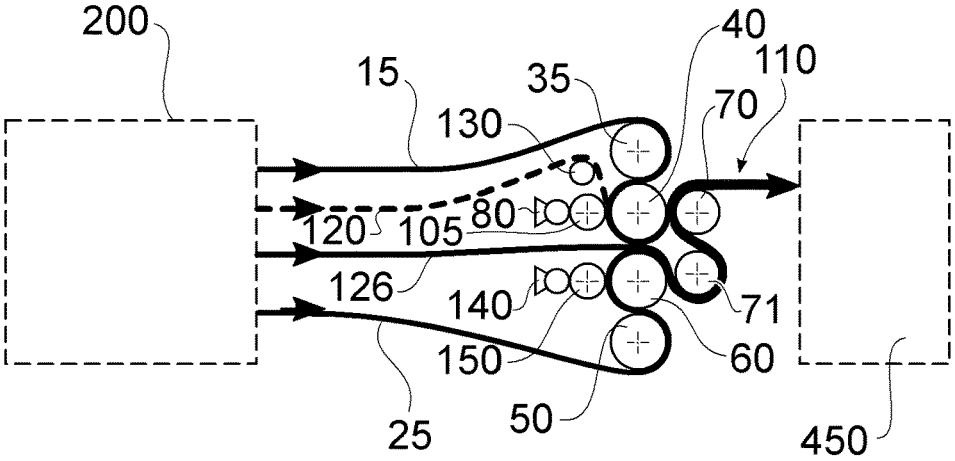
FIG. 12 is a schematic representation of (a part of) and embodiment of a manufacturing apparatus for manufacturing a coreless roll in accordance with the present disclosure with a third embodiment of a method in accordance with the present disclosure.

FIG. 12 depicts another embodiment of an apparatus used for carrying out a method in accordance with the present disclosure for manufacturing a coreless roll including a tissue paper product comprising (at least) three plies.

Most of what is shown is analogous to what was explained above with respect to FIG. 10. Reference is thus made to the corresponding explanations. A difference is that a third ply 120 (represented by a dotted line in FIG. 12) is supplied to the main embosser. It is received and conveyed by another roll 130 and is then led to the embossing roll 40, where it is conveyed further together with the first ply 15. The first ply 15 and the third ply 120 are then ply-bonded together with the second ply 25 between the embossing roll 40 and the marrying roll 70.

The embodiment of a manufacturing apparatus of FIG. 12 is used, in particular, to produce coreless rolls with an outer diameter in the range of 95 to 150 mm, with an inner hole diameter in the range of 20 to 50 mm, and with a density of the coreless roll being in a range of 110 to 160 kg/m$^3$.

The tissue paper product manufacture with the apparatus of FIG. 12 comprises glued areas, where the plies are ply-bonded to each other using an adhesive, such as a lamination glue, and non-glued areas between the glued areas. At least some of the glued areas are glued embossed areas that comprise first embossments of the first ply and second embossments of the second ply, and a sum of areas of all glued embossed areas is at least 6% of a sum of the areas of all glued areas and of areas of all non-glued areas. Moreover, over at least 80% of (the total sum of all surfaces of) the glued embossed areas, a maximum distance between adjacent embossments of the embossed ply is 2.5 mm or less (on both the first ply as well as the second ply).

In the following, some experimental results obtained on the basis of coreless rolls according to an embodiment of the present disclosure will be discussed.

Examples of Coreless Rolls Made of Two-Ply Tissue Product

Coreless rolls of a tissue paper product with two plies made of CWP were manufactured with an outer diameter of 128 mm. The two plies were both embossed using a non-heated embossing roll.

The following table 1 summarizes the number of sheets, the roll length, the roll density, the theoretical caliper, the grammage (the units gsm stands for g/m$^2$), the (sheet) caliper the radial compression strength (in Newton), and the caliper ratio of the manufactured coreless rolls. A comparative example is compared to an example in accordance with the present disclosure.

TABLE 1

| Example | #sheets | Roll length (m) | Roll density (kg/m3) | Th. Caliper (mm) | Grammage (gsm) | 1-sheet caliper (mm) | Radial compression (N) | Caliper ratio |
|---|---|---|---|---|---|---|---|---|
| Comp. 1 | 360 | 45.00 | 126 | 0.27 | 33.4 | 0.37 | 19.9 | 38% |
| 1 | 360 | 45.00 | 125 | 0.27 | 33.1 | 0.4 | 31.8 | 50% |

In the case of the comparative example 1, a sum of areas of all glued embossed areas was 4.6% of a sum of the areas of all glued areas and of areas of all non-glued areas (i.e., of the tissue paper product). Thus, the amount of glued embossed areas was lower than for examples in accordance with the present disclosure.

In the case of example 1, a sum of areas of all glued embossed areas was 6.4% of a sum of the areas of all glued areas and of areas of all non-glued areas (i.e., of the tissue paper product). Moreover, over at least 80% of the glued embossed areas, a maximum distance between adjacent embossments of the embossed ply is 2.5 mm or less.

As can be seen from table 1, example 1 has a significantly higher radial compression strength (31.8N) as compared to reference example 1 (19.9N).

Examples of Coreless Rolls Made of Three-Ply Tissue Product

Coreless rolls of a tissue paper product with three plies made of CWP were manufactured with an outer diameter of 128 mm.

The following table 2 summarizes the number of sheets, the roll length, the roll density, the theoretical caliper, the grammage (the units gsm stands for g/m$^2$), the (sheet)

caliper the radial compression strength (in Newton), the caliper ratio, and the bulk ratio. Table 2 compares a comparative example with an example in accordance with the present disclosure.

TABLE 2

| Example | #sheets | Roll length (m) | Roll density (kg/m3) | Th. Caliper (mm) | Grammage (gsm) | 1-sheet caliper (mm) | Radial compression (N) | Caliper ratio |
|---|---|---|---|---|---|---|---|---|
| Comp. 2 | 240 | 30.00 | 134 | 0.40 | 53.0 | 0.47 | 12.9 | 17% |
| 2 | 240 | 30.00 | 128 | 0.40 | 51.8 | 0.42 | 21 | 5% |

In the case of the comparative example 2, a sum of areas of all glued embossed areas was 4% of a sum of the areas of all glued areas and of areas of all non-glued areas (i.e., of the tissue paper product). Thus, the amount of glued embossed areas was lower than for examples in accordance with the present disclosure.

In the case of example 2, a sum of areas of all glued embossed areas was 6.4% of a sum of the areas of all glued areas and of areas of all non-glued areas (i.e., of the tissue paper product). Moreover, over at least 80% of the glued embossed areas, a maximum distance between adjacent embossments of the embossed ply is 2.5 mm or less.

As can be seen from table 2, example 2 has a significantly higher radial compression strength (21N) as compared to reference example 2 (12.9N).

It will be apparent to those skilled in the art that various modifications and variations can be made in the disclosed devices and systems without departing from the scope of the disclosure. Other aspects of the disclosure will be apparent to those skilled in the art from consideration of the specification and practice of the features disclosed herein. It is intended that the specification and examples be considered as exemplary only. Many additional variations and modifications are possible and are understood to fall within the framework of the disclosure.

The invention claimed is:

1. A method of manufacturing a coreless roll of a tissue paper product including one or a combination of toilet paper or household towel, the tissue paper product comprising at least two plies, wherein the method comprises the steps of:

feeding at least two plies and embossing at least one of the at least two plies to form an embossed ply, wherein all of the fed plies are made of Conventional Wet Press (CWP) paper;

ply-bonding the at least two plies using an adhesive including, a lamination glue, thereby forming glued areas and leaving non-glued areas between the glued areas, wherein at least some of the glued areas are glued embossed areas comprising embossments of the embossed ply, such that a sum of areas of all glued embossed areas is at least 6% of a sum of the areas of all glued areas and of areas of all non-glued areas, to form the tissue paper product;

spirally winding up the tissue paper product on a mandrel to form a coreless roll and to define an axially extending inner hole facing the mandrel, with a first end of the tissue paper product being located on the outer side of the coreless roll and the second end being located at the inner hole;

withdrawing the mandrel, wherein the coreless roll comprises an outer diameter in the range of from 95 to 150 mm and a diameter of the inner hole is in the range of from 20 to 50 mm, and the density of the coreless roll lies in a range of 110 to 160 kg/m$^3$;

wherein the steps of embossing and of ply-bonding are performed such that, over at least 80% of the glued embossed areas, a maximum distance between adjacent embossments of the embossed ply is 2.5 mm or less.

2. The method of claim 1, wherein the steps of embossing the at least one ply and of ply-bonding are performed such that, over at least 80% of the glued embossed areas, an embossment density of at least 20 embossments/cm$^2$, the method comprising the step of providing at least 90% of the adhesive to tips of embossments of the embossed ply, wherein the method comprises embossing the at least one ply with first embossments with a first embossment height and at least one further type of embossments with a height smaller than the first embossment height, and comprises providing at least 90% of the adhesive of the adhesive to tips of the first embossments of the embossed ply in the tissue paper product.

3. The method of claim 1, wherein the ply-bonding is performed to at least 80% of all areas of the embossed ply which have been embossed.

4. The method of claim 1, wherein the embossing to form the embossed ply comprises providing at least 25 embossments to at least 80% of all areas to be embossed and ply-bonded.

5. The method of claim 1, wherein the method comprises the step of coating at least a part of an innermost circumvolution of the absorbent material of the coreless roll at the second end with a stabilizing coating composition.

6. The method of claim 1, wherein the tissue paper product is manufactured to comprise exactly two plies, a first ply and a second ply, wherein the method comprises embossing the first ply and the second ply, the density of the coreless roll lying in a range of 110 to 150 kg/m$^3$, wherein the sum of the areas of all glued embossed areas is at least 6% of the sum of the areas of all glued areas and of all non-glued areas, a caliper of the tissue paper product being at least 0.35 mm or at least 0.40 mm, and a grammage of the tissue paper product being in a range of from 24 g/m$^2$ to 50 g/m$^2$.

7. The method of claim 6, further including the steps of:

embossing the first ply to form first embossments with a first height (h1), the first height (h1) being in a range of 0.2 mm to 2.0 mm;

applying the adhesive to tips of the first embossments of the first ply;

embossing the second ply to form second embossments with a second height (h2), the second height (h2) being in a range of 0.2 mm to 2.0 mm;

embossing the first ply to form third embossments with a third height (h3) smaller than the first height (h1) (h1>h3); and embossing the second ply to form fourth embossments with a fourth height (h3) smaller than the second height (h2) (h2>h4).

8. The method of claim 1, wherein the tissue paper product is manufactured to comprise exactly three plies, the embossed ply being an outermost ply, the density of the coreless roll lying in a range of 130 to 160 kg/m$^3$, wherein the sum of the areas of all glued embossed areas is at least 6% of the sum of the areas of all glued areas and of all non-glued areas, and a caliper of the tissue paper product being at least 0.40 mm, a grammage of the tissue paper product being in a range of from 34 g/m$^2$ to 65 g/m$^2$.

9. The method of claim 8, wherein the three plies are a first ply, a second ply, and a third ply, and wherein the third ply is positioned between the first ply and the second ply, the method further including:

embossing the first ply to form first embossments with a first height (h1), the first height (h1) being in a range of 0.2 mm to 2.0 mm;

applying the adhesive to tips of the first embossments of the first ply;

embossing the second ply to form second embossments with a second height (h2), the second height (h2) being in a range of 0.2 mm to 2.0 mm;

embossing the first ply to form third embossments with a third height (h3) smaller than the first height (h1) (h1>h3); and embossing the second ply to form fourth embossments with a fourth height (h3) smaller than the second height (h2) (h2>h4).

10. The method of claim 8, absent the step of embossing the third ply.

11. The method of claim 8, further including the steps of:

embossing the first ply and the third ply together to form the first embossments on the first ply and the third ply; and one of forming the third embossments only on the first ply but not on the third ply, or, embossing the first ply and the third ply together to form the third embossments on the first ply and the third ply.

12. The method of claim 8, further including the step of:

embossing the third ply of form fifth embossments with a fifth height (h5), the fifth height (h5) being in a range of 0.2 mm to 2.0 mm, wherein the third ply has been embossed separately from the first ply and the second ply.

13. The method of claim 1, wherein the tissue paper product is manufactured to comprise exactly four plies, the density of the coreless roll lying in a range of 130 to 160 kg/m$^3$, wherein the sum of the areas of all glued embossed areas is at least 6% of the sum of the areas of all glued areas and of all non-glued areas, and a caliper of the tissue paper product being at least 0.50 mm.

14. The method of claim 13, wherein the four plies are a first ply, a second ply, a third ply, and a fourth ply, wherein the first ply and the second ply are outermost plies of the tissue paper product, the method comprising the steps of:

embossing the first ply to form first embossments with a first height (h1), the first height (h1) being in a range of 0.2 mm to 2.0 mm;

applying the adhesive to tips of the first embossments of the first ply;

embossing the second ply to form second embossments with a second height (h2), the second height (h2) being in a range of 0.2 mm to 2.0 mm;

embossing the first ply to form third embossments with a third height (h3) smaller than the first height (h1) (h1>h3); and embossing the second ply to form fourth embossments with a fourth height (h4) smaller than the second height (h2) (h2>h4).

15. The method of claim 14, further including embossing the first ply and the third ply together to form the first embossments on the first ply and the third ply, the method not comprising a step of embossing the fourth ply, or the method comprising a step of embossing the fourth ply separately from the first ply, the second ply, and the third ply, and the method comprising the step of forming the third embossments only on the first ply but not on the third ply, or of embossing the first ply and the third ply together to form the third embossments on the first ply and the third ply.

16. The method of claim 14, further including the steps of:

embossing the first ply, the third ply, and the fourth ply together to form the first embossments on the first ply, the third ply, and the fourth ply;

embossing the first ply, the third ply, and the fourth ply together to form the third embossments on the first ply, the third ply, and the fourth ply; or forming the third embossments on the first ply and the third ply, but not on the fourth ply; or forming the third embossments on the first ply, but not on the third ply and the fourth ply.

17. The method of claim 14, further including one of the steps comprising:

embossing the third ply and the fourth ply together separately from the first ply and the second ply; or embossing one of the third ply and the fourth ply separately from the first ply and the second ply, and not embossing the other one of the third ply and the fourth ply; or neither embossing the third ply nor the fourth ply.

18. The method of claim 14, further including the steps of:

embossing the first ply and the third ply together to form the first embossments on the first ply and the third ply;

embossing the fourth ply and the second ply together to form the second embossments on the fourth ply and the second ply; and one of embossing the first ply and the third ply together to form the third embossments on the first ply and the third ply, or forming the third embossments only on the first ply but not on the third ply.

19. The method of claim 1, wherein the tissue paper product is manufactured to comprise exactly five or six plies, the density of the coreless roll lying in a range of 150 to 160 kg/m$^3$, wherein the sum of the areas of all glued areas is at least 6% of the sum of the areas of all glued areas and of all non-glued areas, and a caliper of the tissue paper product being at least 0.60 mm.

20. The method of claim 19, further including the steps of:

embossing at least one of the outermost plies of the tissue paper product to form first embossments with a first height (h1), the first height (h1) being in a range of 0.2 mm to 2.0 mm;

applying the adhesive to tips of the first embossments of the first ply; and embossing the other one of the outermost plies of the tissue paper product to form second embossments with a second height (h2), the second height (h2) being in a range of 0.2 mm to 2.0 mm.

21. A coreless roll of a tissue paper product including one or a combination of toilet paper or household towel, the tissue paper product made of a spirally wound continuous web of tissue paper having a first end and a second end, the web of absorbent material being wound to define an axially extending inner hole centrally positioned relative to the coreless roll and such that the first end is located on the outer side of the coreless roll and the second end is located at the inner hole, wherein the tissue paper product comprises at least two plies, the at least two plies including at least a first ply and a second ply, being the outermost plies of the tissue paper product, wherein all of the plies of the tissue paper product are made of Conventional Wet Press (CWP) paper, wherein the coreless roll has an outer diameter in the range of from 95 to 150 mm, a diameter of the inner hole being in the range of from 20 to 50 mm, and the density of the coreless roll being in a range of 110 to 160 kg/m$^3$, wherein the first ply is embossed with first embossments and the second ply is embossed with second embossments, the tissue paper product comprising glued areas and non-glued areas between the glued areas, where the plies are ply-bonded to each other using an adhesive, wherein at least some of the glued areas are glued embossed areas that comprise first embossments of the first ply and second embossments of the second ply, wherein a sum of areas of all glued embossed areas is at least 6% of a sum of the areas of all glued areas and of areas of all non-glued areas.

22. The coreless roll of a tissue paper product of claim 21, wherein the adhesive includes a lamination glue, and wherein, over at least 80% of the glued embossed areas, a maximum distance between adjacent embossments of the embossed ply is 2.5 mm or less.

* * * * *